US007854207B2

(12) United States Patent
Kuki et al.

(10) Patent No.: US 7,854,207 B2
(45) Date of Patent: Dec. 21, 2010

(54) DATA PROCESSING UNIT AND PATTERN FORMING METHOD

(75) Inventors: Masakazu Kuki, Ichinomiya (JP); Motoshi Kishi, Nagoya (JP); Hirokazu Nakashima, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1174 days.

(21) Appl. No.: 11/267,318

(22) Filed: Nov. 7, 2005

(65) Prior Publication Data

US 2006/0096510 A1 May 11, 2006

(30) Foreign Application Priority Data

Nov. 8, 2004 (JP) ..... 2004-323501
Nov. 8, 2004 (JP) ..... 2004-323502
Nov. 8, 2004 (JP) ..... 2004-323503

(51) Int. Cl.
*D05B 21/00* (2006.01)

(52) U.S. Cl. ..... 112/102.5; 112/470.03; 112/470.06; 700/136

(58) Field of Classification Search ..... 112/102, 112/102.5, 103, 470.03, 470.04, 470.06, 112/470.09, 475.02; 700/136–138
See application file for complete search history.

(56) References Cited

U.S. PATENT DOCUMENTS 5,021,965 A * 6/1991 Olbrich ..... 700/136
5,323,722 A * 6/1994 Goto et al. ..... 112/102.5
5,855,176 A * 1/1999 Takenoya et al. ..... 112/102.5
5,865,133 A * 2/1999 Herbach et al. ..... 112/102.5
6,000,350 A * 12/1999 Koike et al. ..... 112/102.5
6,158,366 A * 12/2000 Codos ..... 112/475.02
6,167,822 B1 * 1/2001 Miyasako et al. ..... 112/102.5
6,499,513 B1 * 12/2002 Couch ..... 112/470.03
6,820,565 B1 11/2004 Kawaguchi et al.
2004/0221783 A1 11/2004 Niimi

FOREIGN PATENT DOCUMENTS

JP A-2004-254987 9/2004
JP A-2004-263350 9/2004

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A printing and embroidering system having a positional data appending system that is adapted to append positional data indicating positions of a first image and a second image with respect to each other to first image data representing the first image to be formed by one of printing and embroidering and second image data representing the second image to be formed by the other one of printing and embroidering, a first image forming unit with a first fabric holding member, which is adapted to form the first image based on the first image data on a fabric being held by the first fabric holding member, and a second image forming unit with a second fabric holding member, which is adapted to form the second image based on the fabric being held by the second fabric holding member, wherein the first image forming unit is provided with a mark forming system, which is adapted to form a predetermined mark represented by the positional data on the fabric, and wherein the second image forming system is provided with a misalignment eliciting system, which is adapted to elicit a misalignment between a position of the predetermined mark formed on the fabric held by the second fabric holding member and a position represented by the positional data appended to the second image data prior to forming the second image.

12 Claims, 24 Drawing Sheets

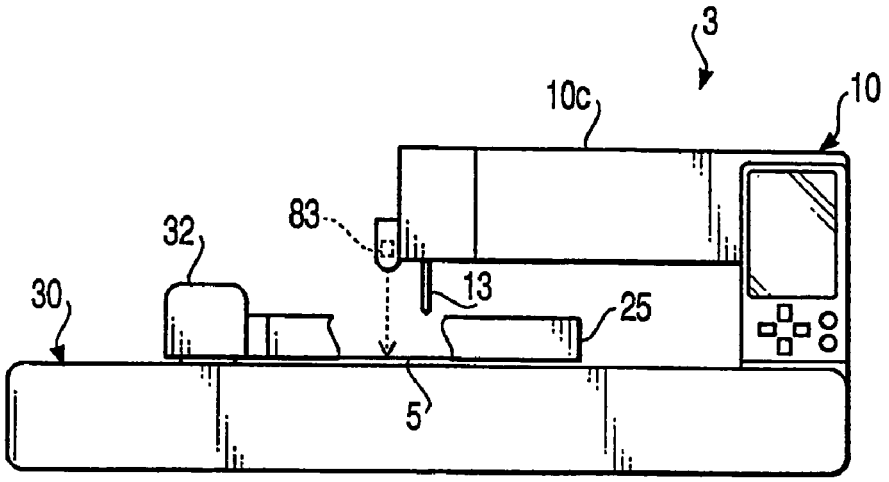

FIG.24

(PATTERN FORMING METHOD)

FIRST STEP
DATA PROCESSING UNIT READS EMBROIDERY DATA AND PRINT DATA

↓

SECOND STEP
DATA PROCESSING UNIT GENERATES REFERENCE MARK PRINT DATA

↓

THIRD STEP
PRINTING DEVICE PRINTS PRINTED PATTERN AND TWO REFERENCE MARKS ON THE FABRIC
PRINTS TWO REFERENCE MARKS ON TEMPLATE ATTACHED TO FABRIC HOLDING FRAME

↓

FOURTH STEP
EMBROIDERY SEWING MACHINE DRIVES FABRIC HOLDING FRAME OF EMBROIDERY SEWING MACHINE WITH THE FABRIC TRANSFERRED FROM FABRIC HOLDING FRAME OF PRINTING UNIT
POSITION OF THE FABRIC IS ADJUSTED BY HAVING THE REFERENCE MARKS ON THE TEMPLATE COINCIDED WITH THE REFERENCE MARKS ON THE FABRIC

↓

FIFTH STEP
EMBROIDERY SEWING MACHINE FORMS EMBROIDERY PATTERN ON THE FABRIC WITH THE TEMPLATE REMOVED FROM THE FABRIC HOLDING FRAME

FIG.25

DATA PROCESSING UNIT AND PATTERN FORMING METHOD

CROSS REFERENCE TO RELATED APPLICATION

This application claims priority from Japanese Patent Applications No. 2004-323501, No. 2004-323502, and No. 2004-323503, filed on Nov. 8, 2004, the entire subject matter of which are incorporated herein by reference.

BACKGROUND OF THE INVENTION

1. Technical Field

Aspects of the invention relate to a data processing apparatus and a method for image forming that are adapted to form an embroidery pattern in a predetermined position with respect to a printed pattern formed on a fabric with a printing device, and that are adapted to form a printed pattern in a predetermined position with respect to an embroidery pattern formed on a fabric with an embroidery sewing machine.

2. Related Art

Conventionally, various embroidery sewing machines that are adapted to form embroidery patterns on fabrics by driving frames to hold the fabrics in two directions independently based on data for the embroidery patterns have been used. Meanwhile, various techniques to form printed patterns on fabrics have also been suggested. As one of such techniques, an inkjet printing device that is capable of forming a printed pattern on a fabric by driving the fabric and a print head relatively in respective directions based on data for the printed pattern is suggested. When both of an embroidery pattern and a printed pattern are formed on a same fabric by using such an embroidery sewing machine and a printing device, generally the two patterns are formed either by forming the printed pattern with the printing device after forming the embroidery pattern with the embroidery sewing machine, or forming the embroidery pattern with the embroidery sewing machine after forming the printed pattern with the printing device.

Generally, each of the embroidery sewing machine and the printing device is respectively provided with a holding instrument such as a frame to hold the fabric. Therefore, when the embroidery pattern and the printed pattern is formed on the same fabric, a process to transfer the fabric from one of the frames of the embroidery sewing machine and the printing device to the other frame is required. In order to omit such a process, the frame for the embroidery sewing machine, of which height is relatively greater, can be considered of being also used as the frame for the printing device. However, in order to form the printed pattern on the fabric in a certain quality, the printing device is required to have the print head in a close proximity with the fabric. In such case, troubles may occur between the print head and the frame, such that the print head may interfere the frame when the frame is detached from or attached to the printing device, or the print head may interfere with the frame to be driven.

In Japanese Patent Provisional Publication 2004-263350, a technique to form an embroidery pattern on a fabric with an embroidery sewing machine based on data for the embroidery pattern that is created based on image data and to print an image on the fabric with an inkjet printing device based on image data is disclosed. In addition, in Japanese Patent Provisional Publication 2004-254987, a general embroidery sewing machine having a sewing system, a frame to hold a fabric, and a frame driving system is disclosed.

When both of an embroidery pattern and a printed pattern are formed by using the embroidery sewing machine and the printing device, as described above, a process to transfer the fabric from one of the frames of the embroidery sewing machine and the printing device to the other frame is required. In such case, it is difficult to form the embroidery pattern and the printed pattern in a predetermined location with respect to each other. However, in the process of transferring the fabric, if the fabric is held by the other frame to be positioned in a predetermined alignment with respect to the pattern (one of the embroidery pattern and the printed pattern) that is already formed on the fabric, both of the embroidery pattern and the printed pattern can be readily formed on the fabric in the predetermined alignment with respect to each other.

However, as the other frame is not provided with any mechanism to adjust the position of the fabric with respect to the pattern that is already formed on the fabric, having the fabric in the predetermined alignment has been difficult. When a size of the one of the frames of the embroidery sewing machine and the printing device and a size of the other frame are identical, the above-described problem can be solved by having a portion of the fabric that was held by the one frame to be similarly held by the other frame. However, even in such a method, the fabric can be easily be misaligned from the predetermined position, and the above-described problem cannot be easily solved. Therefore, in order to prevent the misalignment, a user is required to repeatedly adjust the position of the fabric with respect to the other frame by reattaching the fabric to the other frame, which may be time consuming and troublesome.

When the size of the one of the frames of the embroidery sewing machine and the printing device and the size of the other frame are not identical, even with a reference mark provided to the fabric, having the fabric in the predetermined position with respect to the other frame is even more difficult, as no positioning mechanism to align the fabric in position is provided to the other frame.

SUMMARY OF THE INVENTION

Aspects of the present invention are advantageous, when an embroidery pattern is formed on a fabric after a printed pattern is formed and when a printed pattern is formed on a fabric after an embroidery pattern is formed, in that a data processing apparatus and a method for image forming that are adapted to form a reference mark on the fabric are provided so that the embroidery pattern and the printed pattern can be formed in a predetermined position with respect to each other on the fabric and a quality of the composed patterns can be improved.

BRIEF DESCRIPTION OF THE ACCOMPANYING DRAWINGS

FIG. 24 is a front view of a variation of the embroidery sewing machine according to the first embodiment of the invention.

FIG. 25 is a process chart to illustrate a method for pattern forming according to a second embodiment of the invention.

DETAILED DESCRIPTION

Figure 1:
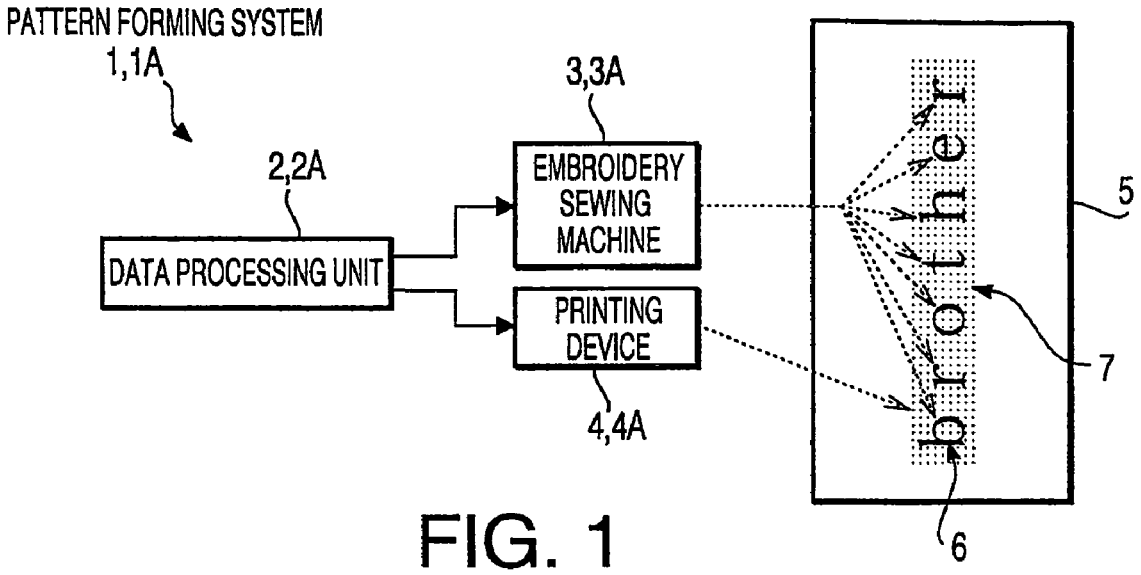
FIG. 1 is a diagram to illustrate pattern forming systems according to illustrative embodiments of the invention.

General Overview of Aspects of the Invention

According to some aspects of the present invention, a printing and embroidering system having a positional data appending system that is adapted to append positional data indicating positions of a first image and a second image with respect to each other to first image data representing the first image to be formed by one of printing and embroidering and second image data representing the second image to be formed by the other one of printing and embroidering, a first image forming unit with a first fabric holding member, which is adapted to form the first image based on the first image data on a fabric being held by the first fabric holding member, and a second image forming unit with a second fabric holding member, which is adapted to form the second image based on the fabric being held by the second fabric holding member, wherein the first image forming unit is provided with a mark forming system, which is adapted to form a predetermined mark represented by the positional data on the fabric, and wherein the second image forming system is provided with a misalignment eliciting system, which is adapted to elicit a misalignment between a position of the predetermined mark formed on the fabric held by the second fabric holding member and a position represented by the positional data appended to the second image data prior to forming the second image is provided.

Optionally, the second image forming unit may be provided with a data modifying system, which is adapted to modify the second image data based on the misalignment elicited by the misalignment eliciting system so that the misalignment is canceled when the second image is formed on the fabric by the second image forming unit, and wherein the second image forming unit may be adapted to form the second image based on the modified second image data.

Optionally, the printing and embroidering system may include a mark position input system, which is adapted to input the position of the predetermined mark formed on the fabric being held by the second fabric holding member, wherein the data modifying system may be adapted to modify the second image data so that the position represented by the positional data appended to the second image data corresponds to the position of the predetermined mark inputted by the mark position input system when the second image is formed on the fabric by the second image forming unit.

Optionally, the mark position input system may include a mark detecting system, which is adapted to detect the predetermined mark formed on the fabric by the first image forming unit and a fabric holding member drive system, which is adapted to drive the second fabric holding member, and wherein the mark input system may be adapted to input the position of the predetermined mark by driving the second fabric holding member and having the position of the detected mark coincided with a predetermined reference position fixed with respect to the second image forming unit.

Optionally, the misalignment eliciting system may be provided with a mark position recording system, which may be adapted to be detachably attached to the first fabric holding member and the second fabric holding member and to have the predetermined mark recorded on the fabric by the first image forming unit according to the positional data. The misalignment eliciting system may be adapted to elicit the misalignment between the position of the predetermined mark on the fabric that is held by the second fabric holding member with respect to the second fabric holding member and the position of the predetermined mark on the fabric that has been held by the first fabric holding member with respect to the first fabric holding member by having the mark position recording system along with the fabric attached to the second fabric holding member.

Optionally, the second fabric holding member may be adapted to modify a position of the fabric held by the second fabric holding member without modifying a position of the mark position recording system by allowing the fabric to be transferred to the second fabric holding member, so that the position of the predetermined mark recorded on the mark position recording system is coincided with the predetermined mark formed on the fabric.

According to some aspects of the present invention, a printing and embroidering method for a printing and embroidering system including a first image forming unit with a first fabric holding member, which is adapted to form a first image on a fabric being held by the first fabric holding member based on first image data representing the first image to be formed by one of printing and embroidering, and a second image forming unit with a second fabric holding member, which is adapted to form a second image on the fabric being held by the second fabric holding member based on second image data representing the second image to be formed by the other one of printing and embroidering, including a positional data appending step wherein positional data of the first image and the second image with respect to each other are respectively appended to the first image data and the second image data, a mark forming step wherein a predetermined mark corresponding to the positional data of the first image data is formed on the fabric by the first image forming unit, and a misalignment eliciting step wherein a misalignment between the position of the predetermined mark formed on the fabric that is held by the second fabric holding member and a position represented by the positional data that is appended to the second image data is provided.

Optionally, the printing and embroidering method may include a data modifying step wherein the second image forming unit modifies the second image data based on the elicited misalignment so that the misalignment is canceled when the second image is formed on the fabric by the second image forming unit.

Optionally, the printing and embroidering method may include a mark position input step wherein the position of the predetermined mark formed on the fabric that is held by the second fabric holding member is inputted, wherein the data modifying step may include a step to modify the second image data so that the position represented by the positional data that is appended to the second image data is coincided with the position of the predetermined mark inputted in the mark position input step when the second image is formed on the fabric by the second image forming unit.

Optionally, the mark position input step may include a detecting step to detect the predetermined mark formed on the fabric by the first imaging unit, a fabric holding member drive step to drive the second fabric holding member to have the detected mark coincided with a predetermined reference position fixed with respect to the second image forming unit, and an input step to input the position of the predetermined mark by having the position of the detected mark coincided with the predetermined reference position fixed with respect to the second image forming unit.

Optionally, the misalignment eliciting step may include a step to elicit the misalignment between the position of the predetermined mark on the fabric that is held by the second fabric holding member with respect to the second fabric holding member and the position of the predetermined mark on the fabric that is held by the first fabric holding member with respect to the first fabric holding member by having a mark position recording system, which is adapted to be detachably attached to the first fabric holding member and the second fabric holding member and to have the predetermined mark recorded on the fabric by the first image forming unit according to the positional data, along with the fabric attached to the second fabric holding member.

Optionally, the printing and embroidering method may include a step to allow the fabric to be transferred to the second fabric holding member, so that the predetermined mark formed on the fabric can be coincided with the mark recorded on the mark position recording system, wherein the second fabric holding member may be adapted to modify a position of the fabric held by the second fabric holding member without changing a position of the mark position recording system.

According to some aspects of the present invention, a printing unit with fabric holding member to provide printing on a fabric held by the fabric holding member based on image data, including a mark detecting system, which is adapted to detect a predetermined mark formed on a fabric, a mark position input system, which is adapted to input the position of the detected predetermined mark, and a modifying system, which is adapted to modify the image data so that a position represented by positional data that is appended to the image data can correspond to the position of the predetermined mark according to positional data appended to the image data and the position of the predetermined mark is provided.

Optionally, the mark position input system may include a mark position record input system, which is adapted to input a position of the detected predetermined mark with respect to the printing unit, and a fabric holding member drive system, which is adapted to drive the fabric holding member, and a pointing system, which is adapted to judge whether a predetermined reference position being fixed with respect to the printing unit is coincided with the position of the detected mark, and wherein a position of the predetermined mark with respect to the fabric holding member may be inputted by having the fabric holding member of the printing unit driven by the fabric holding member drive system and having the detected mark coincided with the predetermined reference position.

Optionally, the printing unit may include a mark position recording system, which is adapted to be de detachably attached to the fabric holding member and to record the position of the predetermined mark formed on the fabric based on the positional data, and a position adjusting system, which is adapted to elicit a misalignment between the position of the predetermined mark on the fabric held by the fabric holding member and a position of the predetermined mark formed on the fabric by having the mark position recording system attached to the fabric holding member with the fabric being held.

Optionally, the position adjusting system may be adapted to modify the position of the fabric held by the fabric holding member without changing a position of the mark position recording system.

According to some aspects of the present invention, an embroidering unit with a fabric holding member to provide embroidery on a fabric held by the fabric holding member based on image data, including a mark detecting system, which is adapted to detect a predetermined mark formed on a fabric, a mark position input system, which is adapted to input the position of the detected predetermined mark, and a modifying system, which is adapted to modify the image data so that a position represented by positional data that is appended to the image data can correspond to the position of the predetermined mark according to positional data appended to the image data and the position of the predetermined mark is provided.

Optionally, the mark position input system may include a mark position record input system, which is adapted to input a position of the detected predetermined mark with respect to the embroidering unit, a fabric holding member drive system, which is adapted to drive the fabric holding member, and a pointing system, which is adapted to judge whether a predetermined reference position being fixed with respect to the embroidering unit is coincided with the position of the detected mark. A position of the predetermined mark with respect to the fabric holding member may be inputted by having the fabric holding member of the embroidering unit driven by the fabric holding member drive system and having the detected mark coincided with the predetermined reference position.

According to some aspects of the present invention, a data processing unit, which is adapted to process embroidery data for forming an embroidery pattern on a fabric by an embroidering unit and printing data for forming a printed pattern on the fabric by a printing unit, including an embroidery data reading system, which is adapted to read the embroidery data, and a reference mark print data generating system, which is adapted to generate reference mark print data for printing a reference mark that indicates a reference position of the fabric in an embroidery area on the fabric in which the embroidery pattern is to be formed according to the embroidery data read by the embroidery data reading system is provided.

Optionally, the embroidery data may include a thread color data of the embroidery pattern. The reference mark print data generating system may be adapted to generate the reference mark print data for printing the reference mark in a color similar to a color of a thread of a patterned portion of the embroidery pattern that is to be formed on the fabric where the reference mark is to be printed based on the thread color data.

According to some aspects of the present invention, a data processing unit, which is adapted to process embroidery data for forming an embroidery pattern on a fabric by an embroidering unit and printing data for forming a printed pattern on the fabric by a printing unit, including a printing data reading system, which is adapted to read the printing data, and a reference mark sewing data generating system, which is adapted to generate reference mark sewing data for sewing a reference mark that indicates a reference position of the fabric outside a print area on the fabric in which the printed pattern is to be formed according to the printing data read by the printing data reading system is provided.

Optionally, the data processing unit may be provided with an embroidery data reading system, which is adapted to read the embroidery data. The reference mark sewing data generating system may be adapted to generate the reference mark sewing data for sewing the reference mark in a position outside an embroidery area on the fabric in which the embroidery pattern is to be formed according the embroidery data read by the embroidery data reading system.

According to some aspects of the present invention, a pattern forming method for forming an embroidery pattern and a printed pattern on a fabric by using an embroidery sewing machine having a sewing system with a needle and a frame drive system that drives a fabric holding frame and a printing unit having a print head and a frame drive system that drives a fabric holding frame, including a first step in which a predetermined data processing unit reads embroidery data for forming an embroidery pattern and print data for forming a printed pattern, a second step in which the data processing unit generates reference mark print data that is used by the printing unit for printing at least two reference marks indicating at least two reference positions on the fabric based on the sewing data and the print data read in the first step is provided.

Optionally, the method may include a third step in which successively to the second step the printing unit forms the printed pattern on the fabric held by the fabric holding frame based on the print data and forms the at least two reference marks on the fabric based on the reference mark print data at one point that is one of before and after the printed pattern is formed.

Optionally, the third step may include having the printing unit print at least two reference marks on a template that is attached to the fabric holding frame of the printing unit based on the reference mark print data and successively having the template and the fabric transferred from the fabric holding frame of the printing unit to the fabric holding frame of the embroidery sewing machine, while a position of the fabric with respect to the fabric holding frame of the embroidery sewing machine can be adjusted so that the at least two reference marks on the fabric are coincided with the at least two reference marks on the template.

Optionally, the method may further include a fourth step in which the at least two reference marks printed on the fabric in the third step are sequentially coincided with a predetermined sewing machine reference position by driving via the frame drive system the fabric holding frame of the embroidery sewing machine with the fabric transferred from the fabric holding frame of the printing unit, a fifth step in which the embroidery sewing machine modifies the embroidery data based on positional information obtained by having the at least two reference marks respectively coincided with the sewing machine reference position so that the embroidery pattern can be formed on the fabric in a predetermined position with respect to the reference marks, and a sixth step in which the embroidery sewing machine forms the sewn pattern on the fabric based on the embroidery data that is modified in the fifth step.

According to some aspects of the present invention, a pattern forming method for forming an embroidery pattern and a printed pattern on a fabric by using an embroidery sewing machine having a sewing system with a needle and a frame drive system that drives a fabric holding frame and a printing unit having a print head and a frame drive system that drives a fabric holding frame, including a first step in which a predetermined data processing unit reads embroidery data for forming an embroidery pattern and print data for forming a printed pattern, a second step in which the data processing unit generates reference mark sewing data that is used by the embroidery sewing machine for sewing at least two reference marks indicating at least two reference positions on the fabric based on the embroidery data and the print data read in the first step is provided.

Optionally, the method may further include a third step in which successively to the second step the embroidery sewing machine forms the embroidery pattern on the fabric held by the fabric holding frame and forms the at least two reference marks on the fabric based on the reference mark sewing data at one point that is one of before and after the embroidery pattern is formed.

Optionally, the method may further include a fourth step in which the at least two reference marks sewn on the fabric in the third step are sequentially coincided with a predetermined printing unit reference position by driving via the frame drive system the fabric holding frame of the printing unit with the fabric transferred from the fabric holding frame of the embroidery sewing machine, a fifth step in which the printing unit modifies the printing data based on positional information obtained by having the at least two reference marks respectively coincided with the sewing machine reference position so that the printed pattern can be formed on the fabric in a predetermined position with respect to the reference marks, and a sixth step in which the printing unit forms the printed pattern on the fabric based on the printing data that is modified in the fifth step.

According to some aspects of the present invention, an embroidery sewing machine including a sewing system with a needle, a fabric holding frame, which is adapted to detachably hold a fabric, a frame drive system, which is adapted to drive the fabric holding frame in two directions independently, a detecting system, which is adapted to detect at least two reference marks indicating at least two reference positions recorded on the fabric held by the fabric holding frame, and a frame drive instruction system, which is adapted to instruct the frame drive system to drive the fabric holding frame to have the at least two reference marks sequentially coincided with a predetermined sewing machine reference position by operating the frame drive system based on detected information from the detecting system is provided.

Optionally, the sewing machine reference position may be a stitch point of the needle.

Optionally, the frame drive instruction system may include a frame drive operation system, which is adapted to operate the frame drive system.

Optionally, the embroidery sewing machine may include a detection activating system that is operated to activate the detecting system.

Optionally, the frame drive instruction system may include an automatic positioning control system, which is adapted to control the frame drive system to have the reference marks to be automatically coincided with the sewing machine reference position.

Optionally, the embroidery sewing machine may include a detection activating system that is operated to activate the detecting system.

Optionally, the embroidery sewing machine may include a display system, which is adapted to display the sewing machine reference position and the reference marks.

Optionally, the display system may display the sewing machine reference position and the reference marks with an embroidery area, which is provided inside the fabric holding frame.

Optionally, the embroidery sewing machine may include an embroidery data modifying system, which is adapted to modify the embroidery data based on positional information obtained by having the at least two reference marks respectively coincided with the sewing machine reference position so that the embroidery pattern can be formed on the fabric in a predetermined position with respect to the at least two reference marks.

According to some aspects of the present invention, a printing unit including a fabric holding frame, which is adapted to detachably hold a fabric, a printing system with a print head that is adapted to print on a fabric held by the fabric holding frame, and a drive system, which is adapted to drive a point to be printed on the fabric by the print head is driven in two directions respectively by driving at least one of the fabric holding frame and the print head, wherein a positioning system, which is adapted to position a predetermined reference position on the fabric held by the fabric holding frame, is provided to the printing unit in a vicinity to the print head is provided.

Optionally, the drive system may include a frame drive system, which is adapted to drive the fabric holding frame in two directions respectively.

Optionally, the positioning system may include a positioning member with one of a cutout and a protrusion that is provided at a predetermined portion in a vicinity to the print head.

Optionally, the positioning system may include a movable positioning member, which is provided at the predetermined portion in the vicinity to the print head and is adapted to be carried close to and apart from the fabric held by the fabric holding member.

Optionally, the positioning system may include an emitting system, which is provided at a predetermined portion in a vicinity to the print head and may be adapted to emit spotlight to the fabric held by the fabric holding frame.

According to some aspects of the present invention, a printing unit including a fabric holding frame, which is adapted to detachably hold a fabric, a printing system with a print head that is adapted to print on a fabric held by the fabric holding frame, a drive system, which is adapted to drive a point to be printed on the fabric by the print head is driven in two directions respectively by driving at least one of the fabric holding frame and the print head, a detecting system, which is adapted to detect at least two reference marks indicating at least two reference positions recorded on the fabric held by the fabric holding frame, and a drive instruction system, which is adapted to instruct the drive system to drive at least one of the fabric holding frame and the print head to have the at least two reference marks sequentially coincided with a predetermined printing unit reference position by operating the drive system based on detected information from the detecting system is provided.

Optionally, the drive system may include a frame drive system, which is adapted to drive the fabric holding frame in two directions respectively, wherein the drive instruction system may include a frame drive instruction system, which is adapted to instruct the frame drive system to drive the fabric holding frame to have the at least two reference marks sequentially coincided with a predetermined printing unit reference position by operating the frame drive system.

Optionally, the printing unit reference position may be a predetermined position of the print head.

Optionally, the frame drive instruction system may include a frame drive operation system, which is adapted to operate the frame drive system.

Optionally, the frame drive instruction system may include an automatic positioning control system, which is adapted to control the frame drive system to have the reference marks to be automatically coincided with the printing unit reference position.

Optionally, the printing unit may include a detection activating system that is operated to activate the detecting system.

Optionally, the printing unit may include a display system, which is adapted to display the printing unit reference position and the reference marks.

Optionally, the display system may display the printing unit reference position and the reference marks with a print area, which is provided inside the fabric holding frame.

Optionally, the printing unit may include a print data modifying system, which is adapted to modify the print data based on positional information obtained by having the at least two reference marks respectively coincided with the printing unit reference position so that the printed pattern can be formed on the fabric in a predetermined position with respect to the at least two reference marks.

EMBODIMENTS

As shown in FIG. 1, pattern forming systems 1, 1A are provided with data processing units 2, 2A that include personal computers, embroidery sewing machines 3, 3A, and inkjet printing devices 4, 4A. The data processing units 2, 2A supply embroidery data (second image data) to the embroidery sewing machines 3, 3A and print data (first data) to the printing devices 4, 4A. Further, the data processing units 2, 2*a* respectively form an embroidery pattern 6 (for example, 'brother') by using the embroidery sewing machines 3, 3A based on the embroidery data and form a printed pattern 7 (for example, a rectangular pattern in the background of 'brother') by using the printing devices 4, 4A based on the print data. It should be noted that the data processing units 2, 2A can be equipped to the embroidery sewing machines 3, 3A respectively or to the printing devices 4, 4A respectively.

Figure 2:
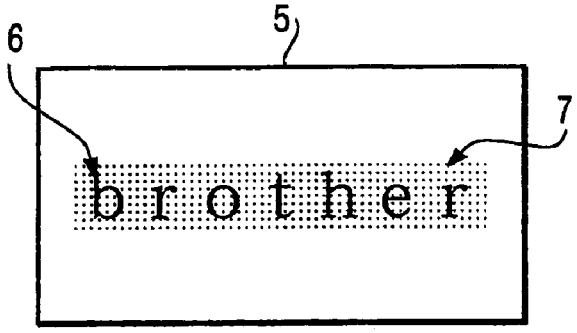
FIG. 2 is a diagram to illustrate an embroidery pattern and a printed pattern formed on a fabric in a predetermined alignment according to the illustrative embodiment of the invention.
Figure 3:
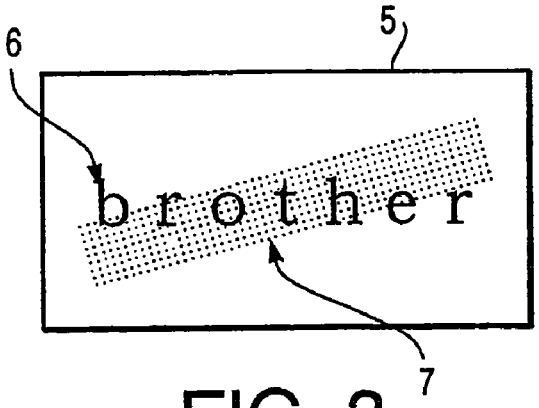
FIG. 3 is a diagram to illustrate an embroidery pattern and a printed pattern formed on a fabric in a misalignment according to the illustrative embodiment of the invention.

Each of the embroidery sewing machines 3, 3A and the printing devices 4, 4A is provided with a dedicated frame (a first and a second fabric holding frames). When both an embroidery pattern 6 and a printed pattern 7 are formed on a same fabric 5, the fabric 5 is transferred from one of the frames of the embroidery sewing machines 3, 3A and the printing devices 4, 4A to the other frame. In such a case, the embroidery pattern 6 and the printed pattern 7 are required to be formed in a predetermined alignment with respect to each other, as shown in FIG. 2. In other words, the embroidery pattern 6 and the printed pattern 7 should not be in misalignment as shown in FIG. 3. The pattern forming systems 1, 1A are provided so that the embroidery pattern 6 and the printed pattern 7 can be formed in a predetermined position with respect to each other on the fabric 5 and a quality of the composed patterns can be improved.

First Embodiment

In the first embodiment, the pattern forming system 1 is configured to form the embroidery pattern 6 and the printed pattern 7 in a predetermined alignment with respect to each other on the fabric 5 with the printed pattern 7 formed on the fabric 5 by using the printing device 4 and the embroidery pattern 6 succeedingly formed on the fabric 5 by using the embroidery sewing machine 3.

[Embroidery Sewing Machine]

Figure 4:
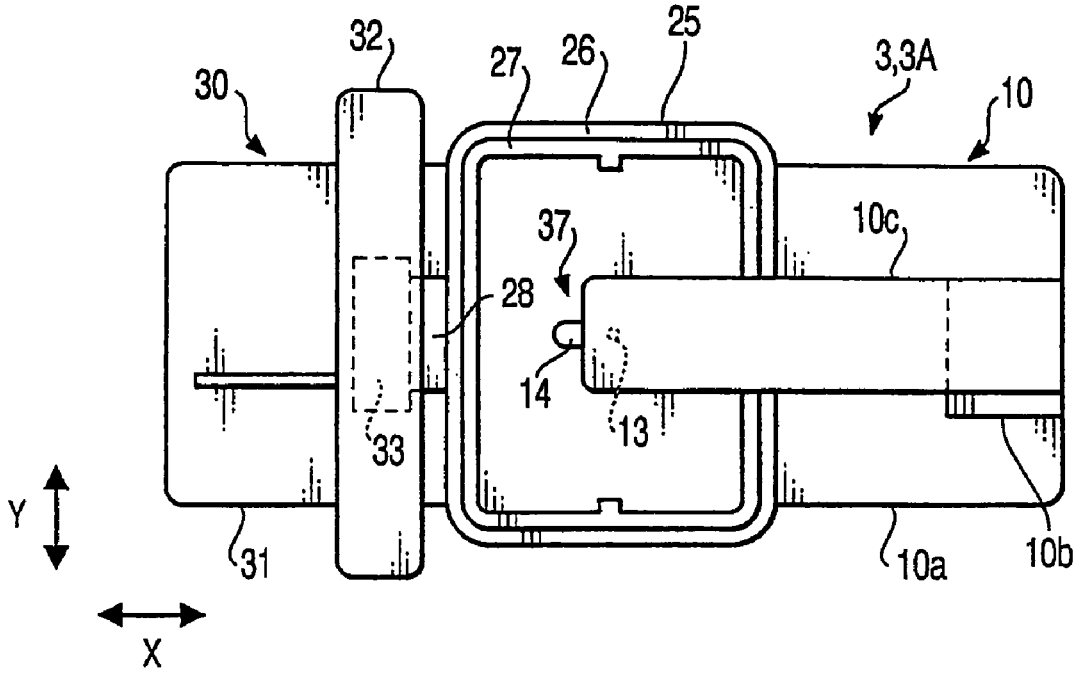
FIG. 4 is a plane view of an embroidery sewing machine according to a first embodiment of the invention.
Figure 5:
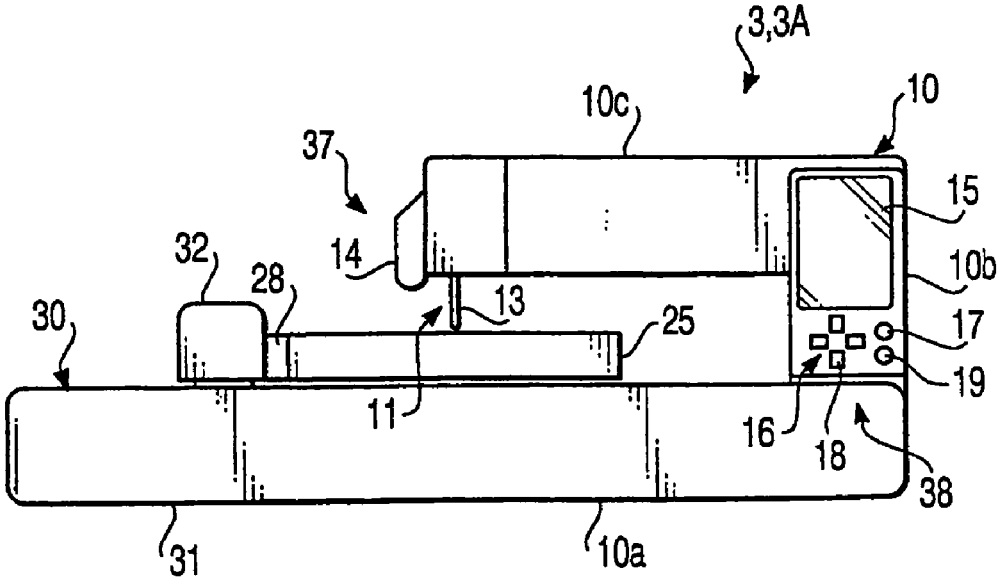
FIG. 5 is a front view of the embroidery sewing machine according to the first embodiment of the invention
Figure 6:
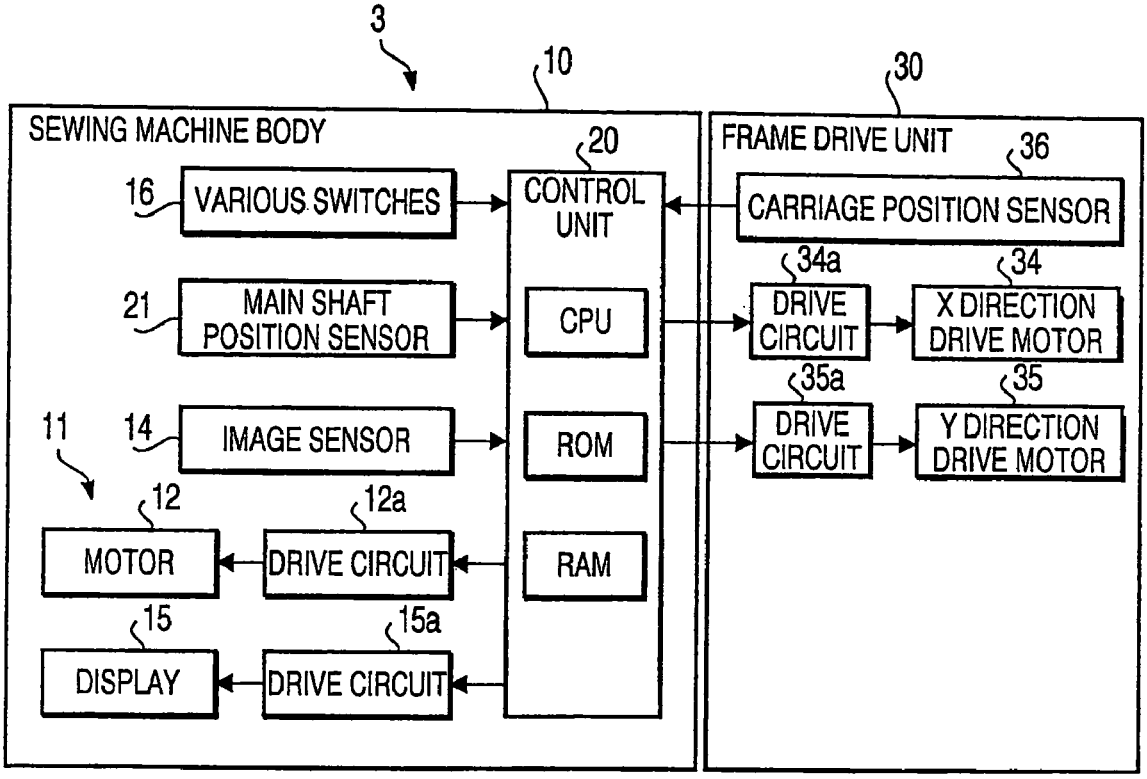
FIG. 6 is a block diagram of a control system of the embroidery sewing machine according to the first embodiment of the invention.

Hereinafter, the embroidery sewing machine 3 will be described. As shown in FIGS. 4 through 6, the embroidery sewing machine 3 includes a machine body 10 having a sewing system 11 with a needle 13, a frame 25 to which the fabric 5 is removably held, and a frame drive unit 30 that drives the frame 25 in two directions (i.e., in an X direction and in a Y direction) respectively.

The machine body 10 includes a bed 10*a*, a pillar 10*b*, and an arm 10*c*. The bed 10*a* is provided with the frame drive unit 30. The sewing system 11 is equipped with a motor 12, a main shaft (not shown) that is rotated by the motor 12, a needle bar (not shown) that is driven in up-and-down motions by driving force transmitted via the main shaft, the needle 13 that is held to the needle bar, a lower shaft (not shown) that is rotated by the driving force transmitted via the main shaft, and a rotary hook (not shown) that is rotated by driving force transmitted via the lower shaft. The needle 13 and the rotary hook work in cooperation with each other to manipulate an upper thread and a lower thread to sew the fabric 5 that is held by the frame 25, which is attached to the frame drive unit 30.

The machine body 10 is provided with an image sensor 14 at a free end of the arm 10*c* (in a vicinity to the needle 13), and a display 15 (a display system) and various switches 16 are provided on a front side of the pillar 10*b*. The image sensor 14 is adapted to read an image of a predetermined area of the fabric 5 that is held by the frame 25, which is attached to the frame drive unit 30. In the present embodiment, the image sensor 14 is configured to read an image from a relatively small area, however, the image sensor 14 may be configured to read an image from a greater area that may approximately coincide with an entire embroidery area 25*a* inside the frame 25.

The machine body 10 is provided with a control unit 20 that includes a microcomputer with a CPU, a ROM, and a RAM. The control unit 20 is connected to the switches 16, a main shaft position sensor 21 that detects a position of the rotating main shaft, the image sensor 14, a drive circuit 12*a* of the motor 12, and a drive circuit 15*a* of the display 15 respectively.

The frame 25 includes an outer frame 26 and an inner frame 27. Between the outer frame 26 and the inner frame 27, the fabric 5 is held and tightened so that the stitches are provided on the fabric 5. The outer frame 26 is integrally provided with a coupler 28, which is detachably attached to a carriage 33 of the frame drive unit 30. Here the frame 25 is formed in a shape of rectangle, however, the frame 25 may be in various shapes including an oval and a circle.

The frame drive unit 30 includes a casing 31, which is provided integrally with or independently from the bed 10*a* of the machine body 10, a movable case 32, which is arranged on the casing 31 and supported by the casing 31 so that the movable case 32 can be guided to move in an X direction, the carriage 33, which is arranged inside the movable case 32 so that the carriage 33 can be guided to move in a Y direction, an X direction drive motor 34 that drives the movable case 32 in the X direction, and a Y direction drive motor 35 that drives the carriage 33 in the Y direction.

The control unit 20 of the machine body 10 is connected with a carriage position sensor 36 that detects a position of the carriage 33 (a position in the X direction and a position in the Y direction) of the frame drive unit 30, a drive circuit 34*a* for the X direction drive motor 34, and a drive circuit 35*a* for the Y direction drive motor 35.

It should be noted that, on the fabric 5, two cross-like reference marks 8, 9 (see FIG. 12) to indicate reference positions of the fabric 5 have been printed by the printing device 4. When the fabric 5 is transferred to the frame 25 of the embroidery sewing machine 3, the fabric 5 is attached to the frame 25 so that the reference marks 8, 9 are located inside the frame 25 (i.e., the embroidery area 25*a*). The embroidery sewing machine 3 is provided with a detecting system 37 that detects the reference marks 8, 9 indicating the two reference positions printed on the fabric 5 by the printing device 4. The detecting system 37 includes the image sensor 14, the control unit 20, and the frame drive unit 30, which have been described above.

The image sensor 14, as described previously, is configured to read an image from a relatively small area on the fabric 5 that is held by the frame 25. With the above-described configuration, the control unit 20 controls the frame drive unit 30, which drives the frame 25, when an instruction to detect the reference marks is received. Then the image sensor 14 scans an image of the entire embroidery area 25*a* on the fabric 5 inside the frame 25, and the image is analyzed so that the two reference marks 8, 9 are detected. Thus, positions of the two reference marks 8, 9 with respect to the frame 25 (i.e., the embroidery area 25*a*), and positions of the two reference marks 8, 9 and the embroidery area 25*a* with respect to a sewing machine reference position 13*a* (a current position), which is provided in a vicinity to the needle 13, can be detected (calculated by the control unit 20).

In the present embodiment, the various switches 16 including detection activating switch 17 (a detection activating system) that is operated to activate the detecting system 37, a frame drive operation switches 18 (a frame drive operation system) that include four arrow keys to drive the frame drive unit 30, and a position recording switch 19 are provided. The embroidery sewing machine 3 is provided with a frame drive instruction system 38 that instructs the frame drive unit 30 to drive the frame 25 so that each of the two reference marks 8, 9 coincides with the sewing machine reference position 13*a* (a predetermined sewing machine reference position) sequentially based on information from the detecting system 37.

Figure 14:
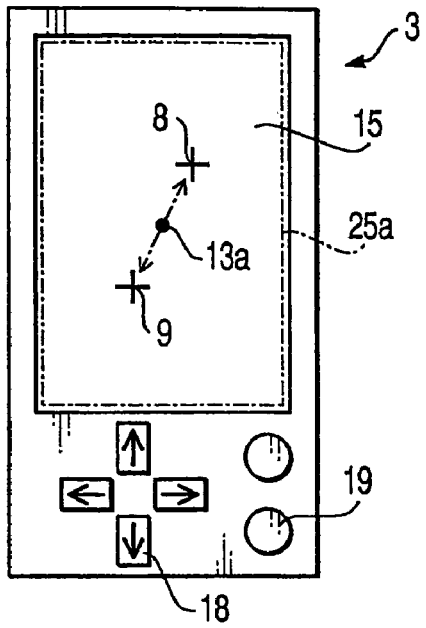
FIG. 14 is an illustrative view of an embroidery area with the reference marks and an initial point for sewing according to the first embodiment of the invention.

The frame drive instruction system 38 includes the frame drive operation switches 18 and the control unit 20. Based on the information from the detecting system 37, the frame drive instruction system 37 shows a positional relation of the sewing machine reference position 13*a*, the two reference marks 8, 9, and the embroidery area 25*a* on the display 15, as shown in FIG. 14. Thus, a user can manipulate the frame 25 via the frame drive operation switches 18 by viewing the positional relation shown on the display 15, and the control unit 20 receiving signals from the frame drive operation switches 18 drives the frame 25 by controlling the X direction drive motor 34 or the Y direction drive motor 35, so that the two reference marks 8, 9 are sequentially coincided with the sewing machine reference position 13*a*.

After the two reference marks 8, 9 are sequentially coincided with the sewing machine reference position 13*a*, positional information (i.e., information of working position of the frame drive unit 30, which is information of position of the carriage 33 detected by the carriage position sensor 36) is recorded by operating the position recording switch 19. The control unit 20 is provided with a function (an embroidery data modifying system) to modify the embroidery data so that the initial embroidery pattern 6 represented by the embroidery data, which is supplied by the data processing unit 2, can be formed on the fabric 5 in the predetermined alignment with respect to the fabric 5 and the printed pattern 7 based on the positional information that is obtained by having the reference marks 8, 9 sequentially coincided with the sewing machine reference position 13*a*.

[Printing Device]

Figure 7:
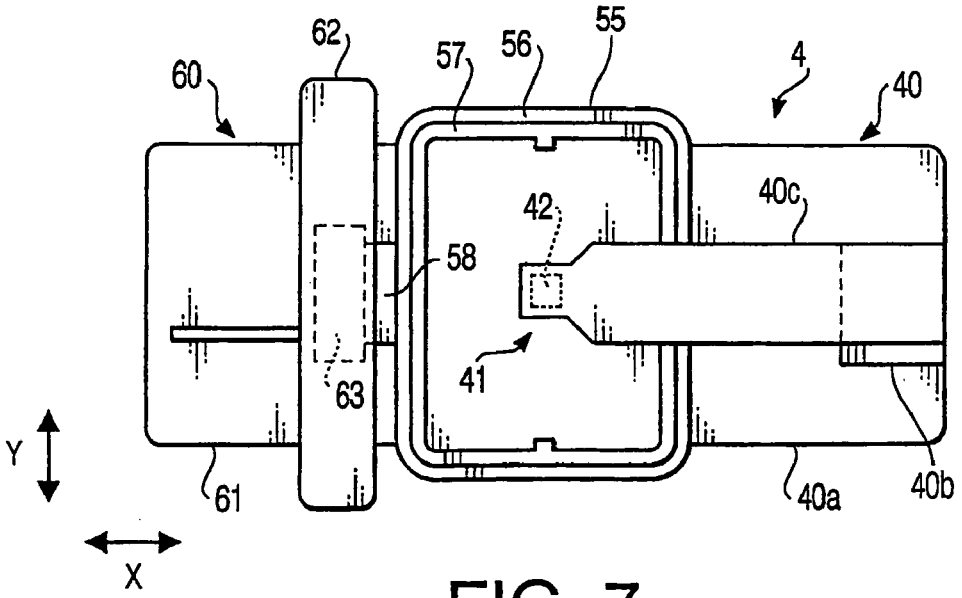
FIG. 7 is a plane view of a printing device according to the first embodiment of the invention.
Figure 8:
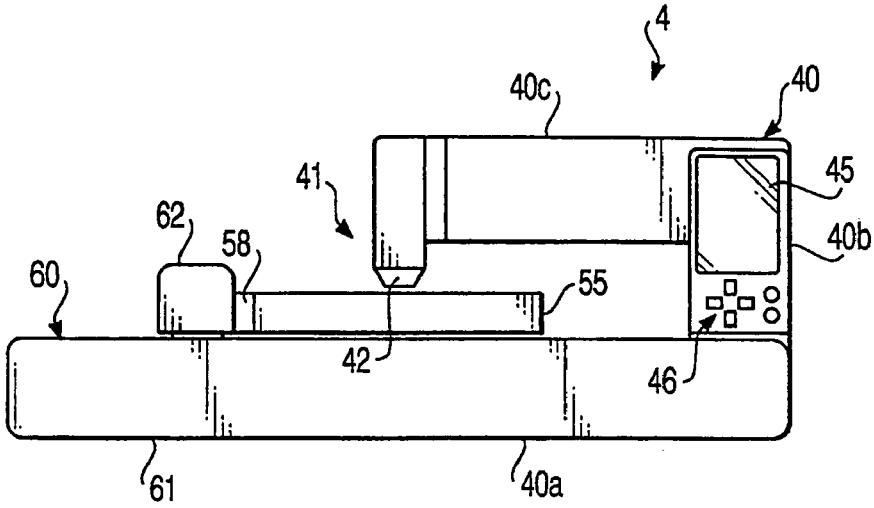
FIG. 8 is a front view of the printing device according to the first embodiment of the invention.
Figure 9:
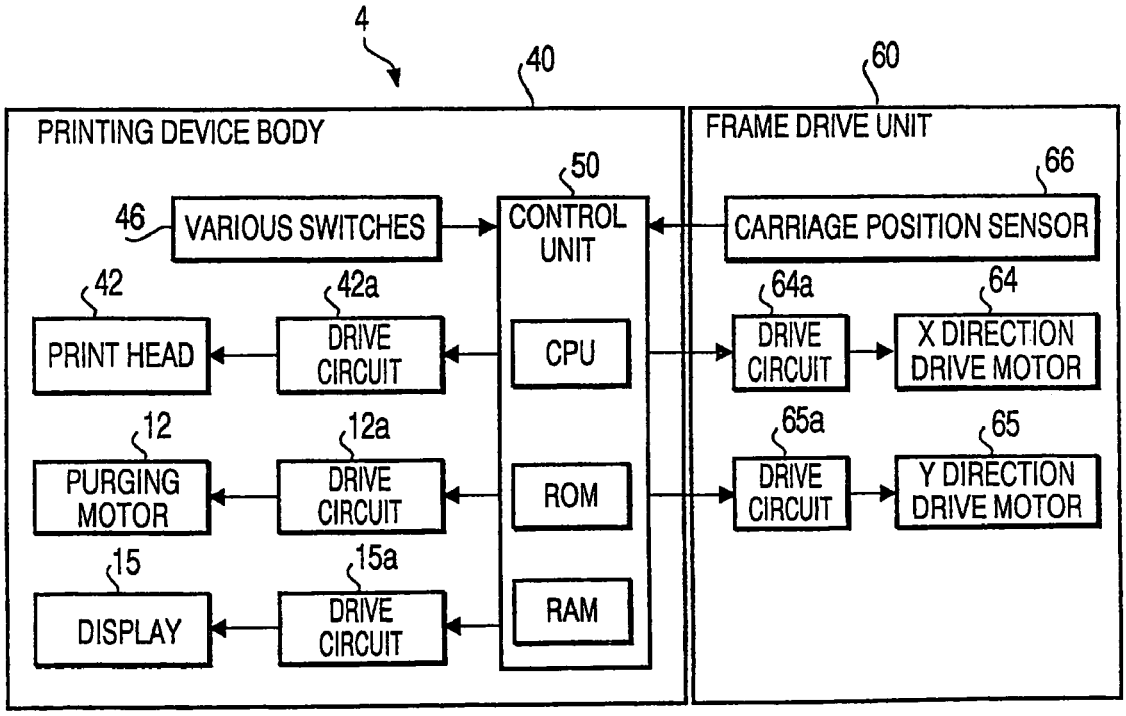
FIG. 9 is a block diagram of a control system of the printing device according to the first embodiment of the invention.

Hereinafter, the printing device 4 will be described. As shown in FIGS. 7 through 9, the printing device 4 includes a frame 55 to which the fabric 5 is removably held, a device body 40 with a printing system 41 having a print head 42 to print on the fabric 5 held to by the frame 55, and a frame drive unit 60 (a drive system) that drives the frame 55 in two directions (i.e., in an X direction and in a Y direction) respectively.

The device body 40 includes a bed 40*a*, a pillar 40*b*, and an arm 40*c*. The bed 40*a* is provided with the frame drive unit 60. The print head 42 is fixed to the device body 40 at a free end of the arm 40*c* in a close proximity to the fabric 5 that is supported by a carriage 63, which is attached to the frame drive unit 60. On the fabric 5, ink from the print head 42 is ejected to form a printed image.

The device body 40 is provided with a display 45 (a display system) and various switches 46 on a front side of the pillar 40*b*. The device body 40 is provided with a control unit 50 that includes a microcomputer with a CPU, a ROM, and a RAM. The control unit 50 is connected respectively to the switches 46, a drive circuit 42*a* of the print head 42, a drive circuit 47*a* of a purging motor 47 that is adapted to purge the print head 42, and a drive circuit 45*a* of the display 45.

The frame 55 includes an outer frame 56 and an inner frame 57. Between the outer frame 56 and the inner frame 57, the fabric 5 is held and tightened so that an image is printed on the fabric 5. The outer frame 56 is integrally provided with a coupler 58, which is detachably attached to the carriage 63 of the frame drive unit 60. Here the frame 55 is formed in a shape of rectangle, however, the frame 55 may be in various shapes including an oval and a circle.

The frame drive unit 60 includes a casing 61, which is provided integrally with or independently from the bed 40*a* of the device body 40, a movable case 62, which is arranged on the casing 61 and supported by the casing 61 so that the movable case 62 can be guided to move in an X direction, the carriage 63, which is arranged inside the movable case 62 so that the carriage 63 can be guided to move in a Y direction, an X direction drive motor 64 that drives the movable case 62 in the X direction, and a Y direction drive motor 65 that drives the carriage 63 in the Y direction.

The control unit 50 of the device body 40 is connected with a carriage position sensor 66 that detects a position of the carriage 63 (a position in the X direction and a position in the Y direction) of the frame drive unit 60, a drive circuit 64*a* for the X direction drive motor 64, and a drive circuit 65*a* for the Y direction drive motor 65.

[Data Processing Unit]

Figure 10:
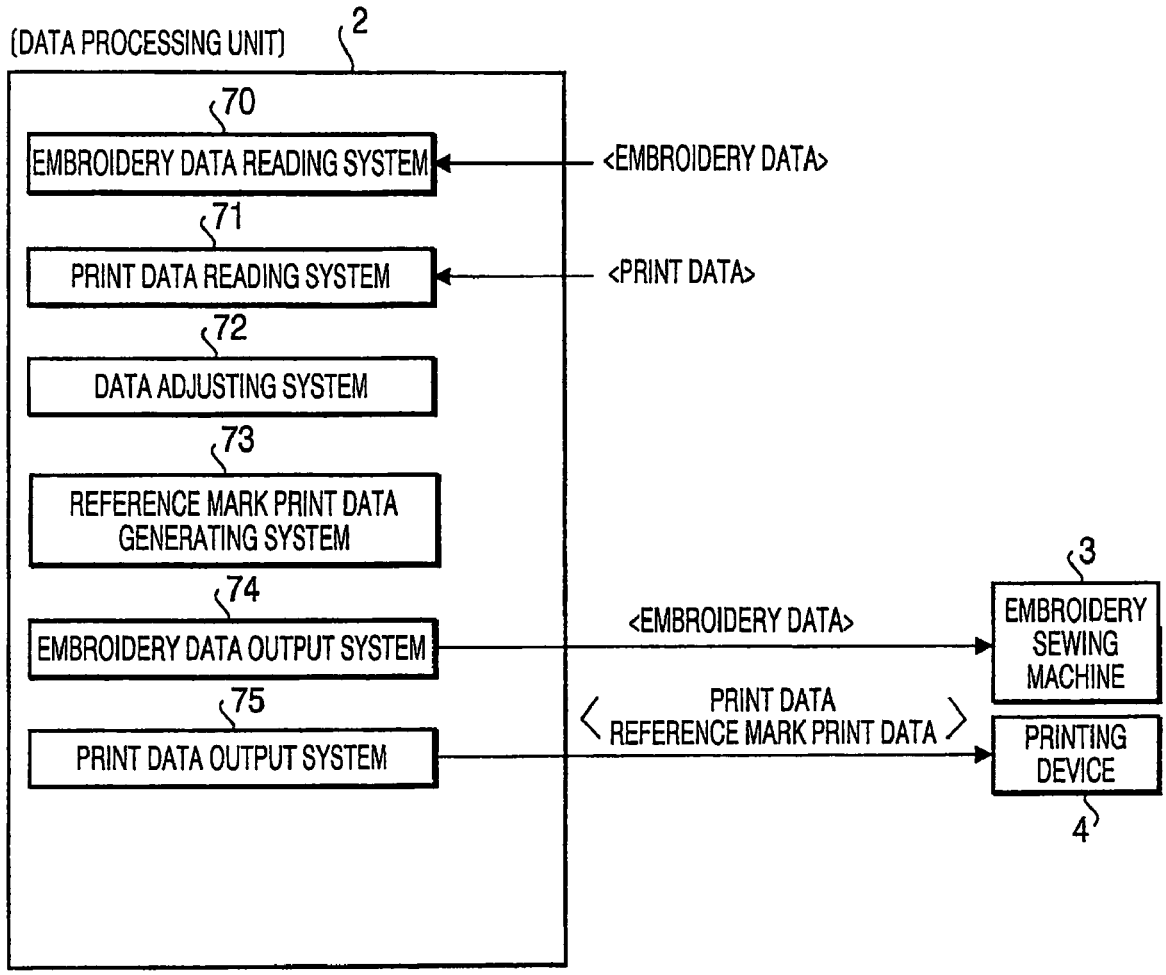
FIG. 10 is a block diagram to illustrate functions of a data processing apparatus according to the first embodiment of the invention.

Hereinafter, the data processing unit 2 will be described. As shown in FIG. 10, the data processing unit 2 is adapted to process the embroidery data for forming an embroidery pattern 6 on the fabric 5 by using the embroidery sewing machine 3 and the print data for forming a printed pattern 7 on the fabric 5 by using the printing device 4. The data processing unit 2 includes an embroidery data reading system 70 that is adapted to read the embroidery data, a print data reading system 71 that is adapted to read the print data, data adjusting system 72, a reference mark print data generating system 73 that is adapted to generate reference mark print data for printing the two cross-like reference marks 8, 9 indicating the two reference positions of the fabric 5 in an embroidery patterned area 6*a* (see FIG. 12) on the fabric 5, in which the embroidery pattern 6 is formed based on the embroidery data read by the embroidery data reading system 70, an embroidery data output system 74, and a print data output system 75.

The data processing unit 2 is adapted to modify the embroidery data read by the embroidery data reading system 70 and the print data read by the print data reading system 71 that represent for example sizes, colors, and positions of the embroidery pattern 6 and the printed pattern 7 to be formed. The data adjusting system 72 of the data processing unit 2 modifies the embroidery data and the print data.

The embroidery data includes thread color data of the embroidery pattern 6. Based on the thread color data, the reference mark print data generating system 73 generates reference mark print data for printing the reference marks 8, 9 in a similar color to a color of a thread of a patterned portion of the embroidery pattern 6 that is to be formed on the fabric 5 where the reference marks 8, 9 are to be printed. It should be noted that when the embroidery data is modified by the data adjusting system 72, the reference mark print data is generated based on the modified embroidery data.

With the above-described procedure, reference mark print data including reference mark positional data, which represents the positions of the two reference marks 8, 9, and reference mark color data, which represents the color of the patterned portion, are generated. Then, the reference mark positional data is added to the initial embroidery data to be generated as current embroidery data. Further, the embroidery data is supplied to the embroidery sewing machine 3 by the embroidery data output system 74, as well as the print data and the reference mark print data are supplied to the printing device 4 by the print data output system 75 online or via a recording medium such as CD and FD.

[Pattern Forming Method]

Figure 11:
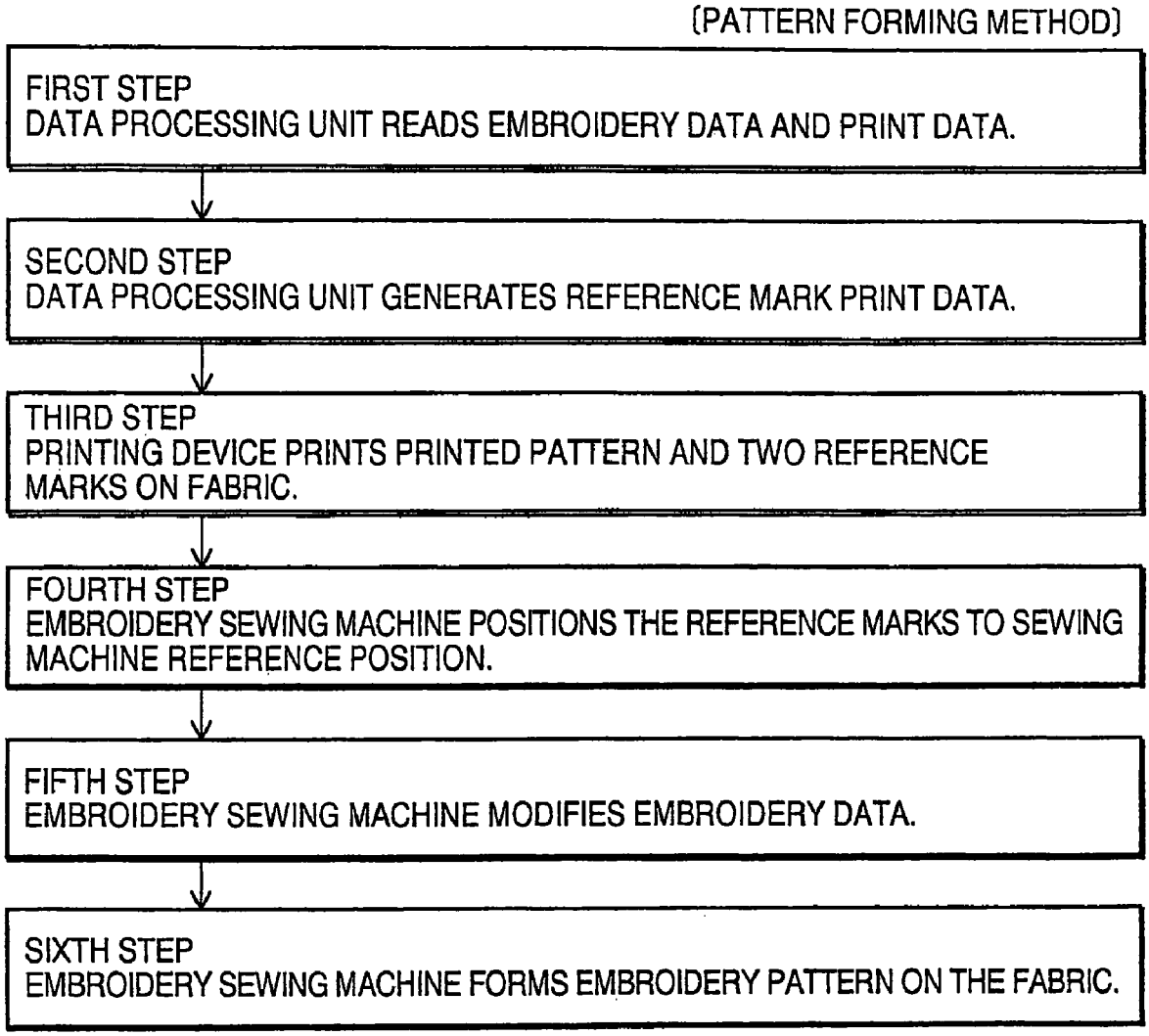
FIG. 11 is a process chart to illustrate a method for pattern forming according to the first embodiment of the invention.

Hereinafter, a pattern forming method will be described. As shown in FIG. 11, the pattern forming method includes steps 1 through 6. In the first step, the data processing unit 2 reads the embroidery data for forming the embroidery pattern 6 and the print data for forming the printed pattern 7. Next, in the second step, the data processing unit 2 generates the reference mark print data for printing the reference marks 8, 9 that indicate the two reference positions of the fabric 5 based on the embroidery data and the print data read in the first step. Further, the data processing unit 2 supplies the embroidery data to the embroidery sewing machine 3 and the print data and the reference mark print data to the printing device 4.

Next, in the third step, the printing device 4 forms the printed pattern 7 on the fabric 5 that is held by the frame 55 of the printing device 4 based on the print data received from the data processing unit 2. Further, before or after the printed pattern 7 is formed on the fabric 5, the printing device 4 prints the two reference marks 8, 9 in the embroidery patterned area 6*a* based on the reference mark print data received from the data processing unit 2 (see FIG. 12). It should be noted that the two reference marks 8, 9 are printed on positions that are spaced from each other to a certain extent (in FIG. 12, the reference marks 8, 9 are located close to corners of the embroidery patterned area 6*a* opposing to each other), and the reference mark print data for forming the reference marks 8, 9 in such positions is generated in the second step.

Then, the fabric 5 is transferred from the frame 55 of the printing device 4 to the frame 25 of the embroidery sewing machine 3. In this regard, the fabric 5 is set in the frame 25 so that the reference marks 8, 9 are brought inside the frame 25 (in the embroidery area 25*a*). Therefore, if the reference marks 8, 9 are located close to the corners opposing to each other, as described above, an approximate midpoint of the reference marks 8, 9 can be a target to be set in the center of the frame 25, and the embroidery patterned area 6*a* can be positioned inside the frame 25. Thus, a situation that the embroidery pattern 6 cannot be formed on the fabric 5 can be avoided.

Figure 13:
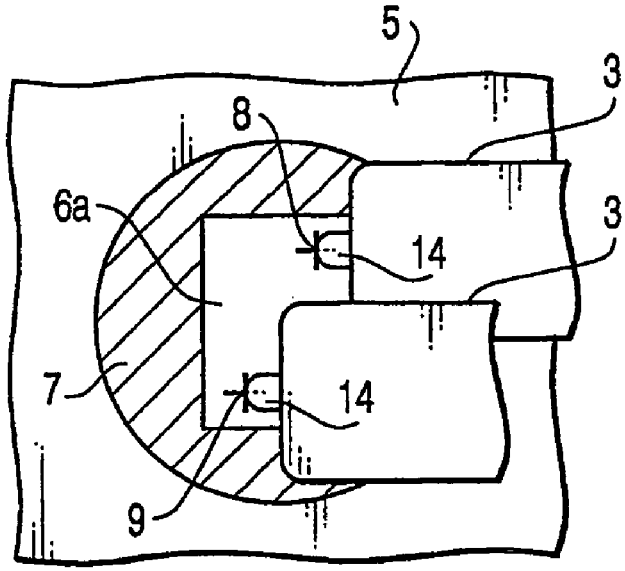
FIG. 13 is an illustrative view of the reference marks being detected according to the first embodiment of the invention.

With the frame 25 holding the fabric 5 attached to the frame drive unit 30 of the embroidery sewing machine 3, the detecting system 37 of the embroidery sewing machine 3 is activated by an operation to the detection activating switch 17. Next, the frame 25 is automatically driven by the frame drive unit 30, and an entire image in the embroidery area 25*a* on the fabric 5 inside the frame 25 is scanned by the image sensor 14 so that the two reference marks 8, 9 can be detected (see FIG. 13). Then the positional relation of the sewing machine reference position 13*a* and the two reference marks 8, 9 with the embroidery area 25*a* is shown on the display 15 (see FIG. 14).

Next, in the fourth step, the frame drive unit 30 of the embroidery sewing machine 3 drives the frame 25 so that the two reference marks 8, 9 printed on the fabric 5 in the third step are sequentially coincided with the sewing machine reference position 13*a*. In this regard, the user can manipulate the frame 25 through the frame drive operation switches 18 by viewing the positional relation shown on the display 15. After the two reference marks 8, 9 are sequentially coincided with the sewing machine reference position 13*a*, positional information (i.e., information of working position of the frame drive unit 30, which is information of position of the carriage 33 detected by the carriage position sensor 36) are recorded by operating the position recording switch 19.

Figure 15:
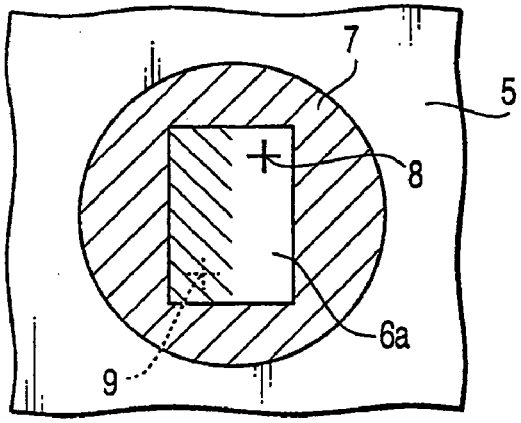
FIG. 15 is an illustrative view of the embroidery pattern being formed on the fabric according to the first embodiment of the invention.
Figure 16:
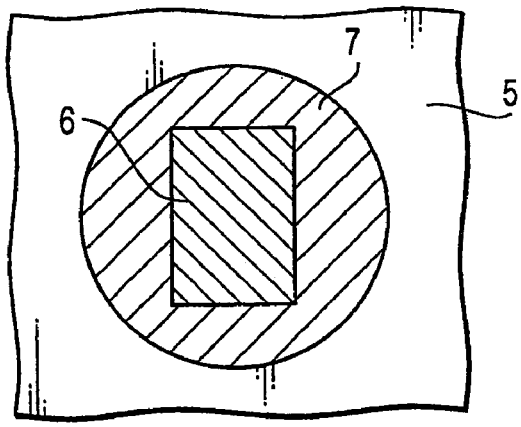
FIG. 16 is an illustrative view of the embroidery pattern having been formed on the fabric according to the first embodiment of the invention.

Next, in the fifth step, based on the positional information that is obtained in the fourth step by having the reference marks 8, 9 sequentially coincided with the sewing machine reference position 13*a*, the embroidery sewing machine 3 modifies the initial embroidery data so that the embroidery pattern 6 can be formed on the fabric 5 in the predetermined alignment with respect to the fabric 5 and the printed pattern 7. Next, in the sixth step, the embroidery sewing machine 3 forms the current embroidery pattern 6 on the fabric 5 based on the embroidery data that has been modified in the fifth step (see FIGS. 15 and 16).

Figure 17:
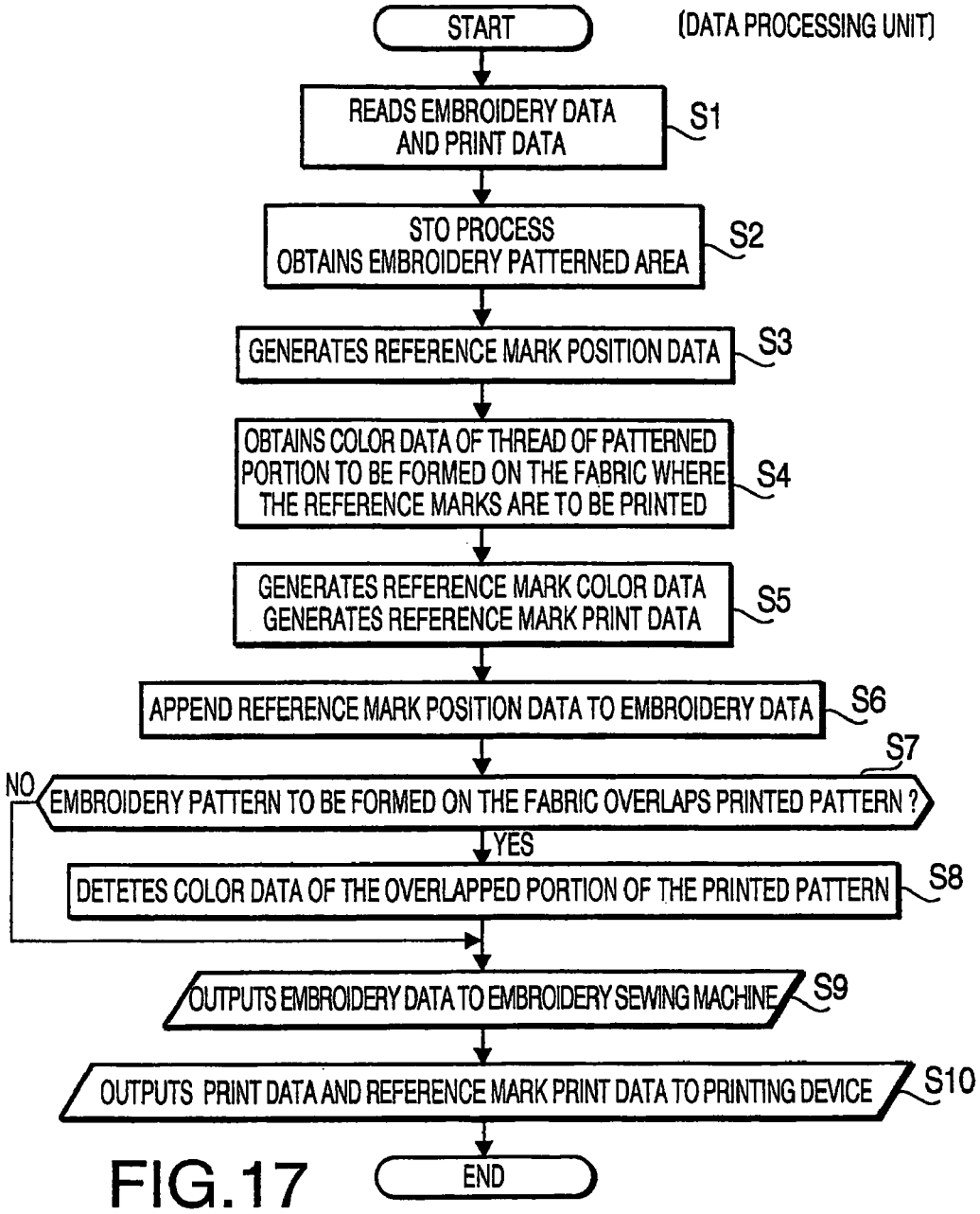
FIG. 17 is a flowchart illustrating a process to be executed by the data processing apparatus according to the first embodiment of the invention.

Hereinafter, a sequence of processes that are executed by the data processing unit 2 will be described. As shown in a flowchart in FIG. 17 (Si (i=1, 2, 3 . . . ) in the flowchart represents each step), when the process is started, the embroidery data and the print data are read (S1). If the embroidery data is required to be modified, outline of the embroidery pattern 6 to be formed with the embroidery data is extracted by a Stitch To Outline process (hereinafter referred to as an STO process) (i.e., a process to extract outlines of the embroidery pattern based on stitch point data that is included in the embroidery data. The stitch point represents a position of stitch point), and the embroidery patterned area 6*a* (i.e., outlines of the embroidery pattern) is obtained (S2). Further, based on the embroidery patterned area 6*a*, the reference mark positional data of the two reference marks 8, 9 is generated (S3).

Next, the color data of the thread of the patterned portion of the embroidery pattern 6 that is to be formed on the fabric 5 where the reference marks 8, 9 are to be printed is obtained (S4). Then, the reference mark color data representing a similar color to the obtained color is generated, and the reference mark print data including the reference mark positional data, which represents the positions of the two reference marks 8, 9, and the reference mark color data, which represents the color of the patterned portion, is generated (S5). Further, the reference mark positional data is added to the initial embroidery data (S6). Next, the process judges whether the embroidery pattern 6 to be formed on the fabric 5 is to overlap the printed pattern 7 to be printed (S7). If the embroidery pattern 6 is determined to overlap the printed pattern 7 (S7: Yes), color data of the overlapped portion of the printed pattern 7 is deleted (S8). Thus, the overlapped portion has no color to be printed. If the embroidery pattern 6 is determined not to overlap the printed pattern 7 (S7: No), as well as after S8, the embroidery data is output to the embroidery sewing machine 3 (S9). Then, the print data and the reference mark print data are output to the printing device 4 (S10), and the process ends.

Figure 18:
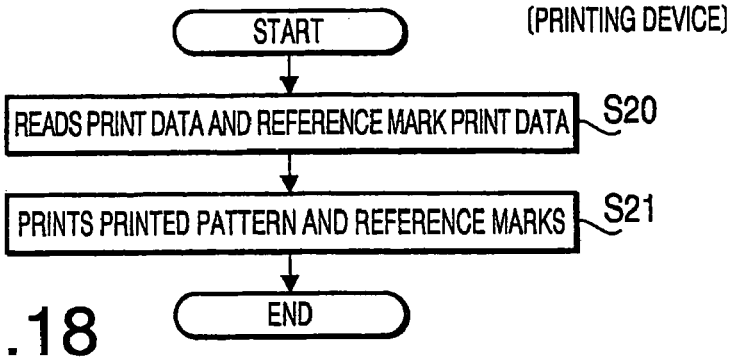
FIG. 18 is a flowchart illustrating a process to be executed by the printing device according to the first embodiment of the invention.

Hereinafter, a sequence of processes that are executed by the printing device 4 will be described. As shown in a flowchart in FIG. 18 (Si (i=20, 21) in the flowchart represents each step), when the process is started, the print data and the reference mark print data that are supplied by the data processing unit 2 are read (S20). Then, the printing system 41 and the frame drive unit 60 are controlled, and the printed pattern 7 and the two reference marks 8, 9 are printed on the fabric 5 (S21), and the process ends.

Figure 19:
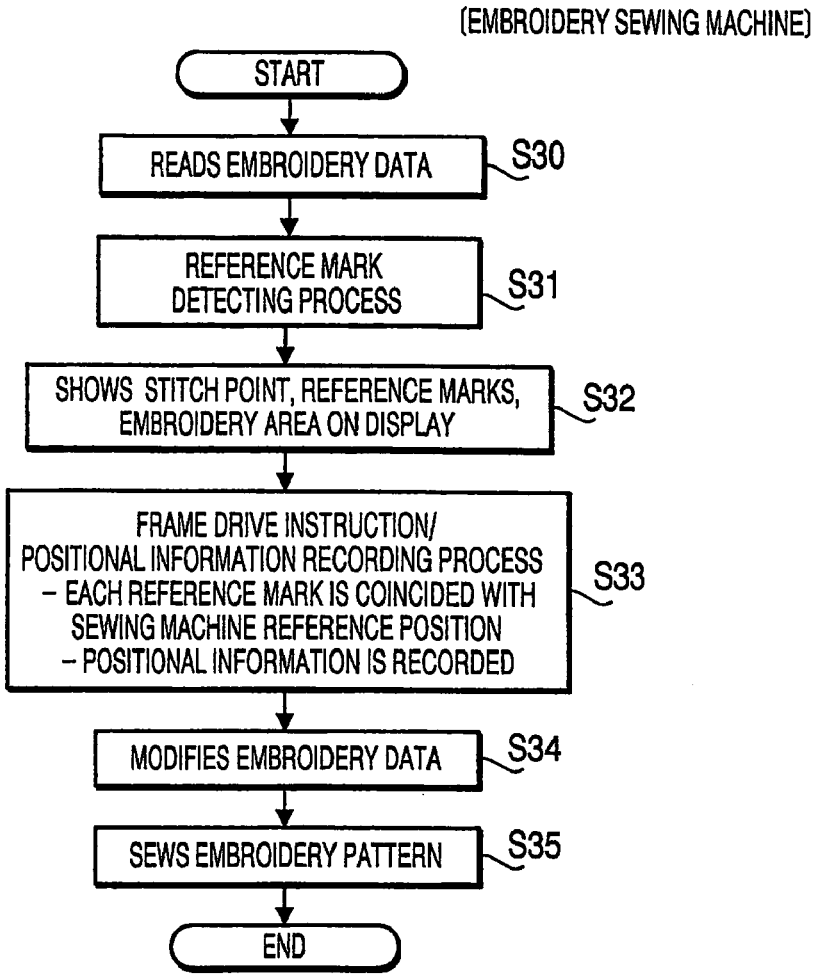
FIG. 19 is a flowchart illustrating a process to be executed by the embroidery sewing machine according to the first embodiment of the invention.

Hereinafter, a sequence of processes that are executed by the embroidery sewing machine 3 will be described. As shown in a flowchart in FIG. 19 (Si (i=30, 31, 32 . . . ) in the flowchart represents each step), when the process is started, the embroidery data that are supplied by the data processing unit 2 is read (S30). Then, in a reference mark detecting process (S31), the image sensor 14 is activated by an operation to the detection activating switch 17, and the frame 25 is driven in a predetermined pattern so that the image on the fabric 5 is scanned and the two reference marks 8, 9 are detected. Then, the sewing machine reference position 13*a* and the reference marks 8, 9 with the embroidery area 25*a* are shown on the display 15 (S32).

Next, in a frame drive instruction/positional information recording process (S33), the frame drive unit 30 drives the frame 25 by an operation to the frame drive operation switches 18 so that the two reference marks 8, 9 can be sequentially coincided with the sewing machine reference position 13*a*. After the two reference marks 8, 9 are coincided with the sewing machine reference position 13*a*, the positional information (i.e., the information of working position of the frame drive unit 30, which is information of position of the carriage 33 detected by the carriage position sensor 36) is recorded by operating the position recording switch 19. Next, based on the positional information, the initial embroidery data is modified by having the reference marks 8, 9 sequentially coincided with the sewing machine reference position 13*a*, and the embroidery pattern 6 can be formed on the fabric 5 in the predetermined position with respect to the fabric 5 and the printed pattern 7 (S34). Then, based on the current embroidery data that has been modified, the sewing system 11 and the frame drive unit 30 are controlled, so that the embroidery pattern 6 is formed (S35). Then, the process ends.

This pattern forming system 1 is advantageous in the followings.

[Embroidery Sewing Machine]

With the detecting system 37, the reference marks 8, 9 that indicate the two reference positions recorded on the fabric 5 that is held by the frame 25 can be detected. Further, with the frame drive instruction system 38, the frame drive unit 30 can have instructions to drive the frame 25 based on the detected information from the detecting system 37 so that the two reference marks 8, 9 can be sequentially coincided with the sewing machine reference position 13*a*. In other words, the two reference marks 8, 9 can be respectively coincided with the sewing machine reference position 13*a* in a simple and reliable manner, and based on the positional information obtained in such a manner, the embroidery pattern 6 can be formed on the fabric 5 in the predetermined position with respect to the reference marks 8, 9.

With the above-described configuration, the printed pattern 7 can be previously formed to be in the predetermined position with respect to the two reference marks 8, 9 on the fabric 5 before the embroidery pattern 6 is formed on the same fabric 5, and the reference marks 8, 9 as well can be formed on the fabric 5 prior to the embroidery pattern 6. Therefore, in such a case that the embroidery pattern 6 is formed on the fabric 5 after the printed pattern 7 is formed on the fabric 5 that is held by the frame 55 of the printing device 4 and the fabric 5 is transferred to the frame 25 of the embroidery sewing machine 3, the embroidery sewing machine 3 is advantageous.

In other words, when the fabric 5 held by the frame 55 of the printing device 4 with the printed pattern 7 formed is transferred to the frame 25 of the embroidery sewing machine 3, the fabric 5 does not require to be positioned specifically with respect to the frame 25 as long as the two reference marks 8, 9 and the embroidery patterned area 6*a* in which the embroidery pattern 6 is to be formed are brought inside the frame 25 (i.e., the embroidery area 25*a*) of the embroidery sewing machine 3. Thus, the process to set the fabric 5 specifically in a predetermined position, which may be time consuming and troublesome, can be omitted. After the fabric 5 is transferred to the frame 25 of the embroidery sewing machine 3, and the detecting system 37 and the drive instruction system 38 are operated, the embroidery pattern 6 can be formed on the fabric 5 so that the embroidery pattern 6 and the printed pattern 7 can be formed in the predetermined position with respect to each other, and thus, a quality of the composed patterns can be improved.

As the frame drive instruction system 38 includes the frame drive operation switches 18, which are used for operating the frame drive unit 30, the frame 25 is configured to be driven by the frame drive operation switches 18 via the frame drive unit 30 to have the two reference marks 8, 9 sequentially coincided with the sewing machine reference position 13*a*. Further, with the detection activation switch 17 that is operated to activate the detecting system 37, the detecting system 37 can be stopped while sewing is performed by the embroidery sewing machine 3, and after the fabric 5 is transferred to the frame 25, the detecting system 37 can be activated when the embroidery pattern 6 is formed on the fabric 5 so that the two reference marks 8, 9 recorded on the fabric 5 can be detected in the reliable manner.

With the display 15 that shows the sewing machine reference position 13*a* and the two reference marks 8, 9, the sewing machine reference position 13*a* and the two reference marks 8, 9 can be easily recognized, and the user can manipulate the frame 25 by viewing the positional relation of the two reference marks 8, 9 shown on the display 15 when the two reference marks 8, 9 are sequentially coincided with the sewing machine reference position 13*a*. Further, as the display 15 shows the sewing machine reference position 13*a* and the two reference marks 8, 9 as well as the embroidery area 25*a* inside the frame 25, the user can easily recognize the sewing machine reference position 13*a* and the two reference marks 8, 9 with the embroidery area 25*a*.

Furthermore, with the embroidery data modifying system that modifies the embroidery data based on the positional information obtained by having the reference marks 8, 9 sequentially coincided with the sewing machine reference position 13*a*, the initial embroidery data can be modified to be the embroidery data to be formed on the fabric 5, so that the current embroidery pattern 6 can be formed on the fabric 5 specifically in the predetermined alignment with respect to the two reference marks 8, 9.

[Data Processing Unit]

With the reference mark print data generating system 73, the reference mark print data, which is for printing the two reference marks 8, 9 indicating the reference positions of the fabric 5, and for printing the reference marks 8, 9 on the fabric 5 in the embroidery patterned area 6*a*, in which the embroidery pattern 6 is formed based on the embroidery data read by the embroidery data reading system 70, can be generated. Based on the reference mark print data, the two reference marks 8, 9 can be printed on the fabric 5 by the printing device 4.

When the embroidery pattern 6 and the printed pattern 7 are formed in the predetermined alignment with respect to each other on the fabric 5 with the printed pattern 7 formed on the fabric 5 by using the printing device 4 and the embroidery pattern 6 succeedingly formed on the fabric 5 by using the embroidery sewing machine 3, as described above, the fabric 5 is required to be transferred from the frame 55 of the printing device 4 to the frame 25 of the embroidery sewing machine 3. In this regard, the data processing unit 2 is advantageous in forming the embroidery pattern 6 and the printed pattern 7 on the fabric 5 in the predetermined alignment with respect to each other.

In other words, the two reference marks 8, 9 are formed on the fabric 5 by the printing device 4 as well as the printed pattern 7 is formed to be in the predetermined position with respect to the reference marks 8, 9. Next, after having the fabric 5 transferred from the frame 55 of the printing device 4 to the frame 25 of the embroidery sewing machine 3, the embroidery pattern 6 can be formed to be in the predetermined alignment with respect to the two reference marks 8, 9 on the fabric 5. Accordingly, the embroidery pattern 6 and the printed pattern 7 can be formed on the fabric 5 in the predetermined alignment with respect to each other. In addition, the reference marks 8, 9 that are printed on the fabric 5 can be covered with the embroidery pattern 6, therefore, an appearance and a quality of the composed patterns are improved.

The embroidery data includes the thread color data of the embroidery pattern 6, and as the reference mark print data generating system 73 generates reference mark print data for printing the reference marks 8, 9 in a color similar to a color of a thread of a patterned portion of the embroidery pattern 6 that is to be formed on the fabric 5 where the reference marks 8, 9 are to be printed, the reference marks 8, 9 printed on the fabric 5 are indistinctive with the embroidery pattern 6 covering over the reference marks 8, 9.

[Pattern Forming Method]

In the first step, the data processing unit 2 is adapted to read the embroidery data for forming the embroidery pattern 6 and the print data for forming the printed pattern 7. In the second step, the data processing unit 2 is further adapted to generate the reference mark print data for printing the reference marks 8, 9 that indicate the two reference positions of the fabric 5 by the printing device 4 based on the embroidery data and the print data read in the first step. Accordingly, the embroidery pattern 6 and the printed pattern 7 can be formed on the fabric 5 in the predetermined alignment with respect to each other.

Following the second step, the printing device 4 is adapted to form the printed pattern 7 on the fabric 5 that is held by the frame 55 of the printing device 4 based on the print data, and before or after the printed pattern 7 is formed on the fabric 5, the printing device 4 is further adapted to print the two reference marks 8, 9 based on the reference mark print data. Accordingly, the printed pattern 7 can be formed on the fabric 5 in the predetermined position with respect to the reference marks 8, 9, and the two reference marks 8, 9 as well as the printed pattern 7 can be printed on the fabric 5.

With the fabric 5 transferred from the frame 55 of the printing device 4 to the frame 25 of the embroidery sewing machine 3, the embroidery sewing machine 3 is adapted to manipulate the frame 25 via the frame drive unit 30. Further, in the fourth step, the embroidery sewing machine 3 is adapted to have the two reference marks 8, 9 printed on the fabric 5 in the third step to be sequentially coincided with the sewing machine reference position 13*a*. In the fifth step, based on the positional information that is obtained in the fourth step by having the reference marks 8, 9 sequentially coincided with the sewing machine reference position 13*a*, the embroidery sewing machine 3 is adapted to modify the initial embroidery data so that the embroidery pattern 6 can be formed on the fabric 5 in the predetermined alignment with respect to the reference marks 8, 9. In the sixth step, the embroidery sewing machine 3 is adapted to form the embroidery pattern 6 on the fabric 5 based on the current embroidery data that has been modified in the fifth step.

Accordingly, when the fabric 5 with the printed pattern 7 formed by the printing device 4 is transferred from the frame 55 of the printing device 4 to the frame 25 of the embroidery sewing machine 3, the fabric 5 does not require to be positioned specifically with respect to the frame 25 as long as the two reference marks 8, 9 and the embroidery patterned area 6*a* in which the embroidery pattern 6 is to be formed are brought inside the frame 25 (i.e., the embroidery area 25*a*) of the embroidery sewing machine 3. Thus, the process to set the fabric 5 in a predetermined position, which may be time consuming and troublesome, can be omitted, and the embroidery pattern 6 and the printed pattern 7 can be readily and reliably formed on the fabric 5 in the predetermined alignment with respect to each other.

The first embodiment can be altered as follows.

[Embroidery Sewing Machine] 1] The frame drive instruction system 38 may include the control unit 20 (an automatic positioning control system) that controls the frame drive unit 30 to have the two reference marks 8, 9 to be automatically coincided with the sewing machine reference position 13*a*. In such case, the frame drive operation switches 18 can be omitted, and the sewing machine reference position 13*a* and the reference marks 8, 9 are not required to be shown on the display 15. In this regard, the two reference marks 8, 9 formed on the fabric 5 that is held by the frame 25 can be detected by the detecting system 37, and the positions of the two reference marks 8, 9 (current positions) with respect to the sewing machine reference position 13*a* can be detected. Therefore, the embroidery sewing machine 3 can be configured to calculate a distance in the X direction and a distance in the Y direction from the current positions to the sewing machine reference position 13*a*, so that the frame 25 can be driven for the calculated distances in the two directions to have the reference marks 8, 9 to be sequentially coincided with the sewing machine reference position 13*a*. In such case, the positional information of the reference marks 8, 9 sequentially coincided with the sewing machine reference position 13*a* can also be automatically recorded. In this regard, the position recording switch 19 can be omitted.

2] The sewing machine reference position 13*a*, which is located in the vicinity to the needle 13, can be located in another position. The sewing machine reference position is preferable to be located in a vicinity of the free end of the arm 10*c* (in a vicinity to the needle 13) of the machine body 10. In such a location, a positioning system for positioning the two reference marks 8, 9 on the fabric 5 held by the frame 25 can be provided in a vicinity of the free end of the arm 10*c* (in a vicinity to the needle 13) so that the two reference marks 8, 9 can be respectively coincided with the sewing machine reference position. Examples of such a configuration will be described below.

Figure 20:
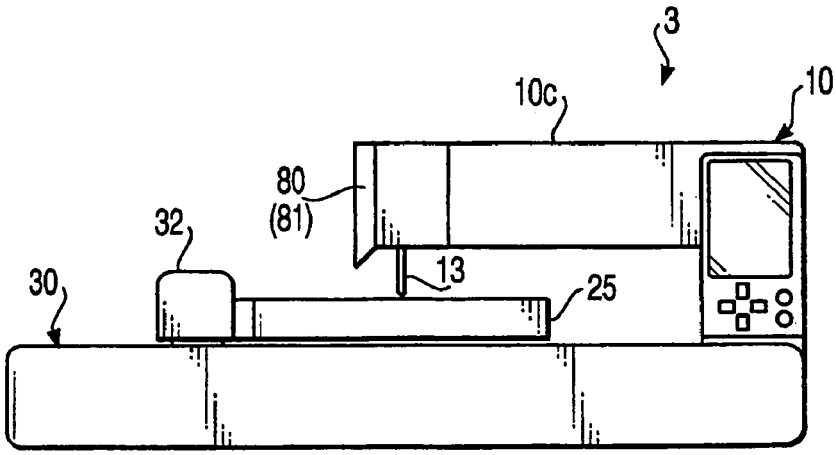
FIG. 20 is a front view of a variation of the embroidery sewing machine according to the first embodiment of the invention.
Figure 21:
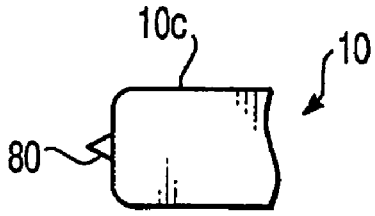
FIG. 21 is a plane view of an essential part of the embroidery sewing machine shown in FIG. 20 according to the first embodiment of the invention.
Figure 22:
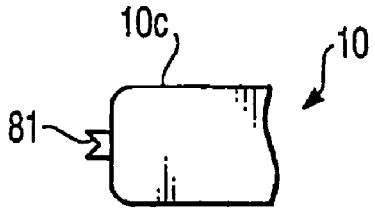
FIG. 22 is a plane view of an essential part of the embroidery sewing machine shown in FIG. 20 according to the first embodiment of the invention.

2-1] As shown in FIGS. 20 and 21, the positioning system including a positioning member 80 with a protrusion is provided at a predetermined portion of the arm 10*c* of the machine body 10. 2-2] As shown in FIGS. 20 and 22, the positioning system including a positioning member 81 with a cutout is provided at a predetermined portion of the arm 10*c* of the machine body 10.

Figure 23:
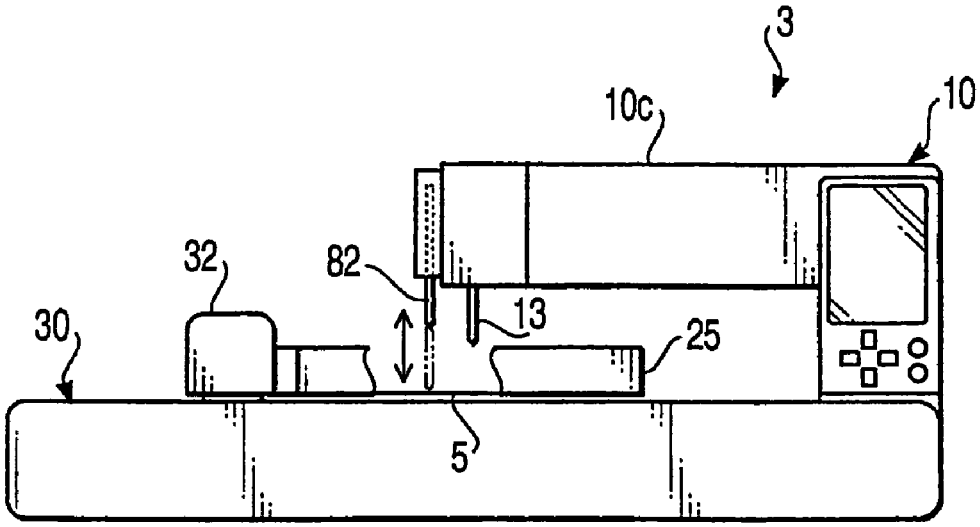
FIG. 23 is a front view of a variation of the embroidery sewing machine according to the first embodiment of the invention.

2-3] As shown in FIG. 23, the positioning system including a movable positioning member 82 that can be positioned close to or far from the fabric 5 held by the frame 25 is provided at a predetermined portion of the arm 10*c* of the machine body 10. In this case, the movable positioning member 82 can be configured to move manually or automatically. 2-4] As shown in FIG. 24, the positioning system including a spotlight 83 as an emitting system that emits spotlight to the fabric 5 held by the frame 25 is provided at a predetermined portion of the arm 10*c* of the machine body 10.

3] The number of the reference marks is not limited to two, but may be more than two. 4] When each of the embroidery pattern 6 and the printed pattern 7 is a symmetrical pattern with respect to a point, the number of the reference mark can be one. In this case, the one reference mark can be formed as the symmetrical point of the pattern to be formed on the fabric.

[Printing Device] 5] The print head 42 of the device body 40 can be configured to be driven in the Y direction (or the X direction), while the frame drive unit 60 is configured to be driven only in the X direction (or the Y direction), so that the point to be printed by the print head 42 with respect to the fabric 5 can be moved in the two directions independently.

[Data Processing Unit] 6] The reference mark print data generating system 73 can be adapted to generate reference mark print data for printing reference marks indicating the reference positions of the fabric 5 in various shapes (for example dots, circles, line segments) other than the crosses. 7] The reference mark print data generating system 73 can be configured to generate reference mark print data for printing the reference marks 8, 9 in colors other than a similar color to the color of the thread of the patterned portion of the embroidery pattern 6 that is to be formed on the fabric 5.

Figure 12:
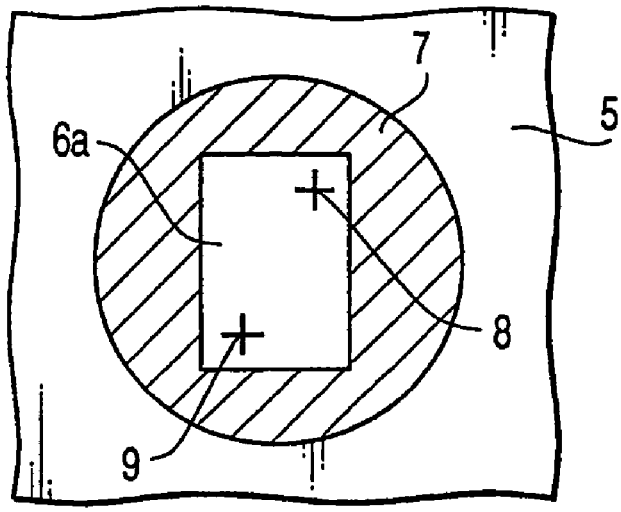
FIG. 12 is an illustrative view of the printed pattern and reference marks formed on the fabric according to the first embodiment of the invention.

[Pattern Forming Method] It should be noted that in FIG. 12 the embroidery patterned area 6*a* is provided inside the printed pattern 7, however, the printed pattern 7 can be provided inside the embroidery patterned area 6*a*. In such case, the reference marks 8, 9 should be provided inside the embroidery patterned area 6*a* and outside the printed pattern 7.

Second Embodiment

In the second embodiment, as shown in FIG. 25, the first step and the second step are similar to the first step and the second step of the first embodiment.

Figure 26:
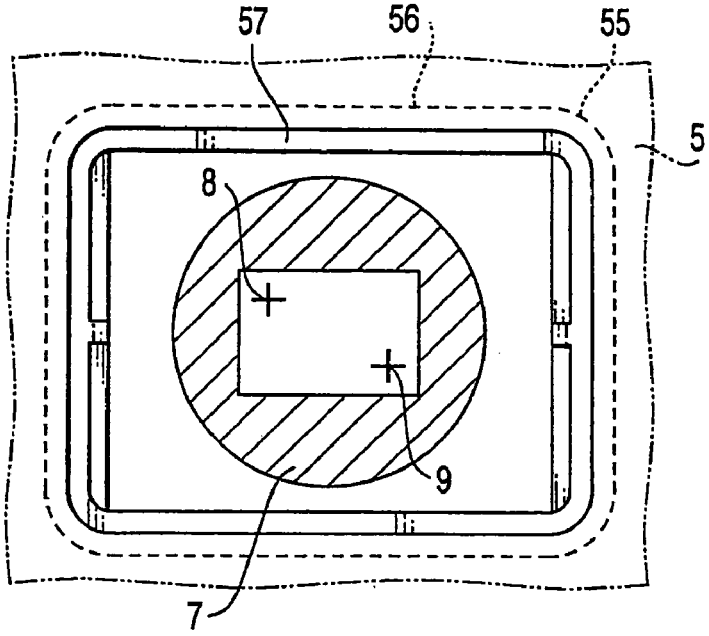
FIG. 26 is an illustrative view of a method for pattern forming according to the second embodiment of the invention.
Figure 27:
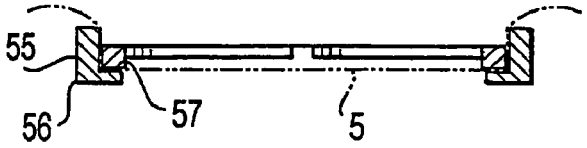
FIG. 27 is an illustrative view of the method for pattern forming according to the second embodiment of the invention.
Figure 28:
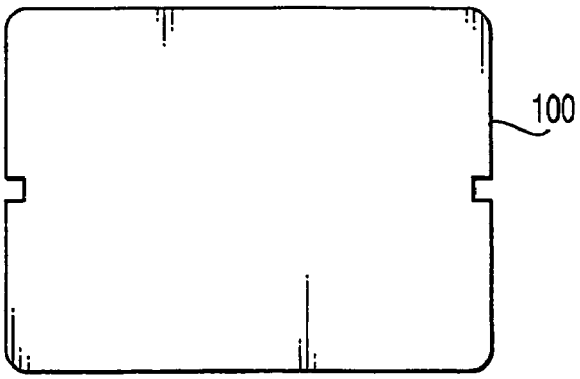
FIG. 28 is an illustrative view of the method for pattern forming according to the second embodiment of the invention.
Figure 29:
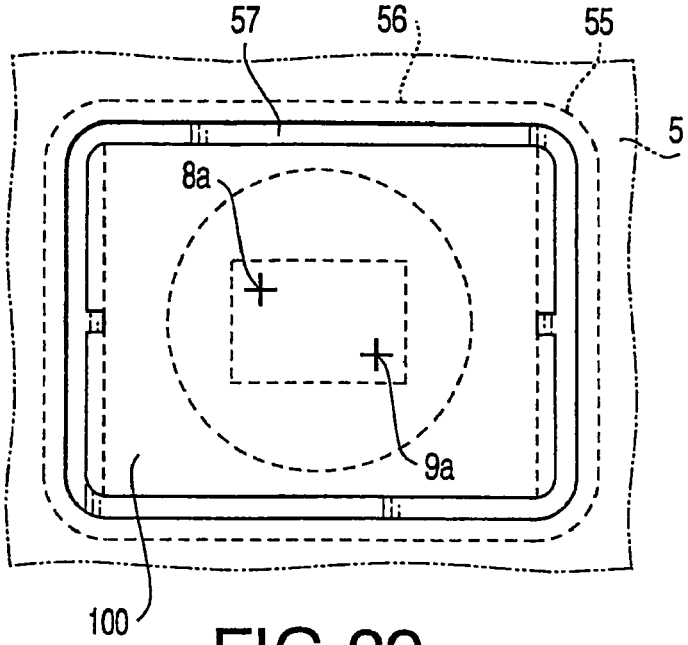
FIG. 29 is an illustrative view of the method for pattern forming according to the second embodiment of the invention.
Figure 30:
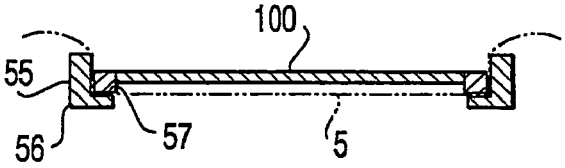
FIG. 30 is an illustrative view of the method for pattern forming according to the second embodiment of the invention.
Figure 31:
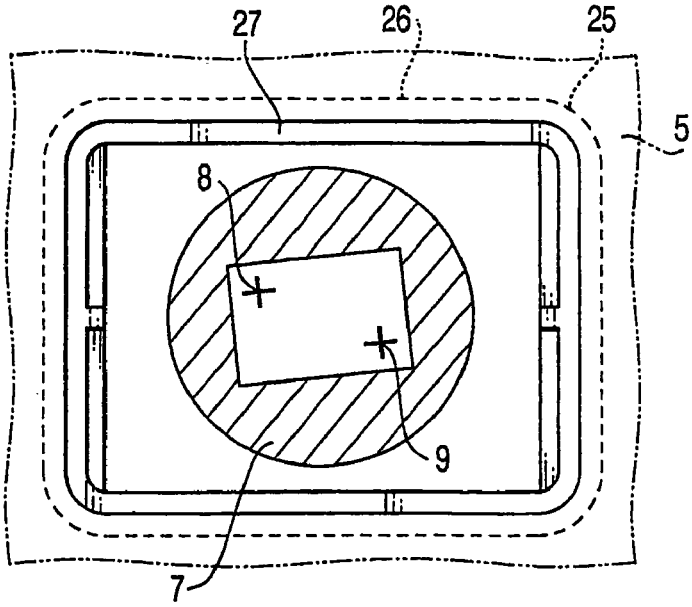
FIG. 31 is an illustrative view of the method for pattern forming according to the second embodiment of the invention.

In the third step, the printing device 4 forms the printed pattern 7 on the fabric 5 that is held by the frame 55 of the printing device 4 based on the print data received from the data processing unit 2. Further, before or after the printed pattern 7 is formed on the fabric, the printing device 4 prints the two reference marks 8, 9 based on the reference mark print data received from the data processing unit 2 (see FIGS. 26, 27). Then, as shown in FIG. 28, a template 100, which is formed with a transparent or translucent plate, is attached to the frame 55 of the printing device 4. Further, the printing device 4 prints the two reference marks 8*a*, 9*a* on the template 100 based on the reference mark print data (see FIGS. 29, 30).

Figure 32:
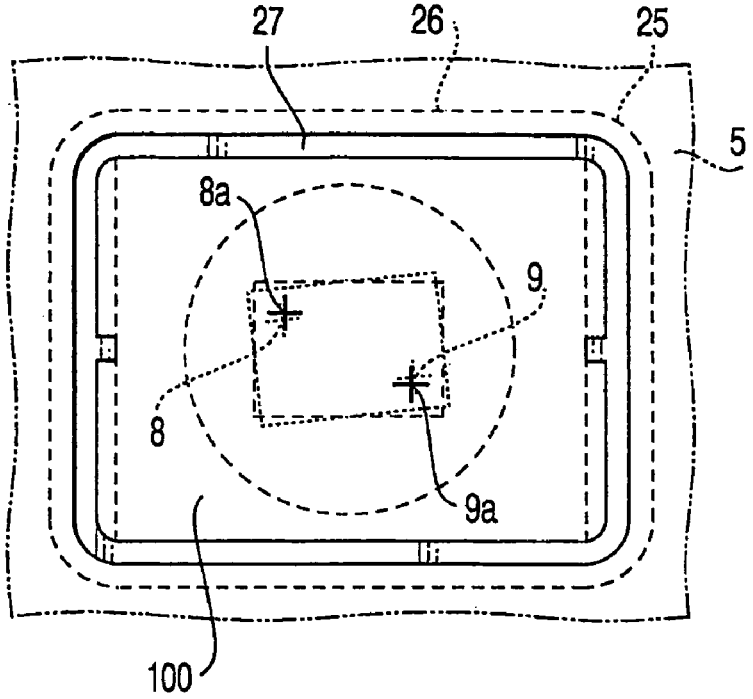
FIG. 32 is an illustrative view of the method for pattern forming according to the second embodiment of the invention.

Next, the fabric 5 is transferred from the frame 55 of the printing device 4 to the frame 25 of the embroidery sewing machine 3 (see FIG. 32) with the two reference marks 8, 9 on the fabric 5 being misaligned with two reference marks 8*a*, 9*a* on the template 100. Then, the position of the fabric 5 with respect to the frame 25 of the embroidery sewing machine 3 is adjusted so that the two reference marks 8, 9 on the fabric 5 are coincided with the two reference marks 8*a*, 9*a* on the template 100 (the fourth step).

Figure 33:
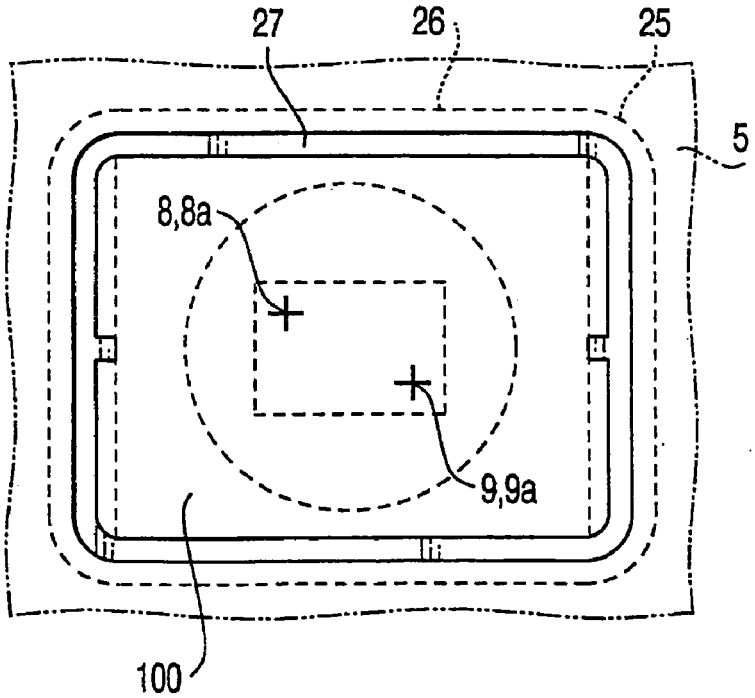
FIG. 33 is an illustrative view of the method for pattern forming according to the second embodiment of the invention.
Figure 34:
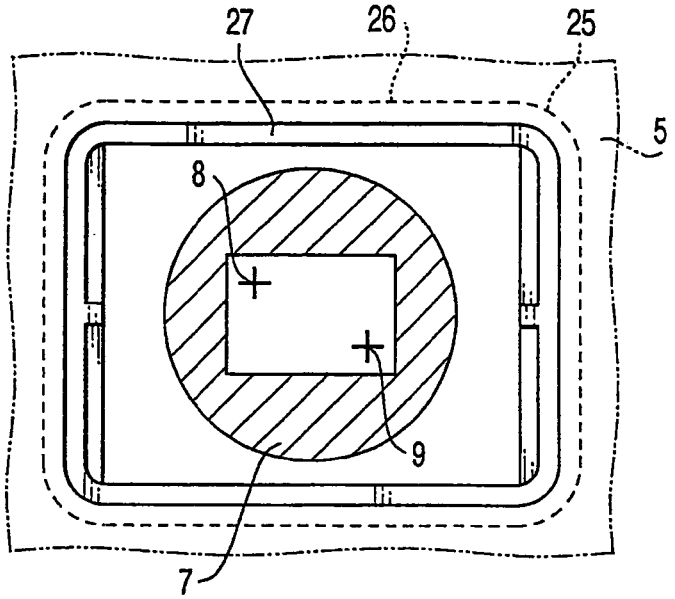
FIG. 34 is an illustrative view of the method for pattern forming according to the second embodiment of the invention.

With the above-described procedure, when the two reference marks 8, 9 on the fabric 5 are coincided with the two reference marks 8*a*, 9*a* on the template 100 (see FIG. 33), in the fifth step, after the template 100 is removed from the frame 25, the embroidery sewing machine 3 forms the embroidery pattern 7 on the fabric 5 based on the embroidery data. It should be noted that, in the third step, the template 100 can be attached to the frame 55 before the printed pattern 7 as well as the reference marks 8, 9 are formed on the fabric 5, so that the reference marks 8*a*, 9*a* can be firstly printed on the template 100, and the printed pattern 7 as well as the reference marks 8, 9 can be formed after the template 100 is removed from the frame 55.

For conducting the above-described method, the pattern forming system 1 in the first embodiment can be applied in use. In this regard, the image sensor 14, i.e., the detecting system 37, the detection activating switch 17, the frame drive operation switches 18 i.e., the frame drive instruction system 38, and the position recording switch 19 can be omitted. In other words, the fabric 5 can be set in the frame 25 of the embroidery sewing machine 3 in the predetermined position by using the template 100 without a specific detecting system provided to the embroidery sewing machine 3, and the embroidery pattern 6 and the printed pattern 7 can be formed in the predetermined alignment with respect to each other.

Third Embodiment

In the third embodiment, the pattern forming system 1A is configured to form the embroidery pattern 6 and the printed pattern 7 in a predetermined alignment with respect to each other on the fabric 5 with the embroidery pattern 6 formed on the fabric 5 by using the embroidery sewing machine 3A and the printed pattern 7 succeedingly formed on the fabric 5 by using the printing device 4A.

[Embroidery Sewing Machine]

Figure 35:
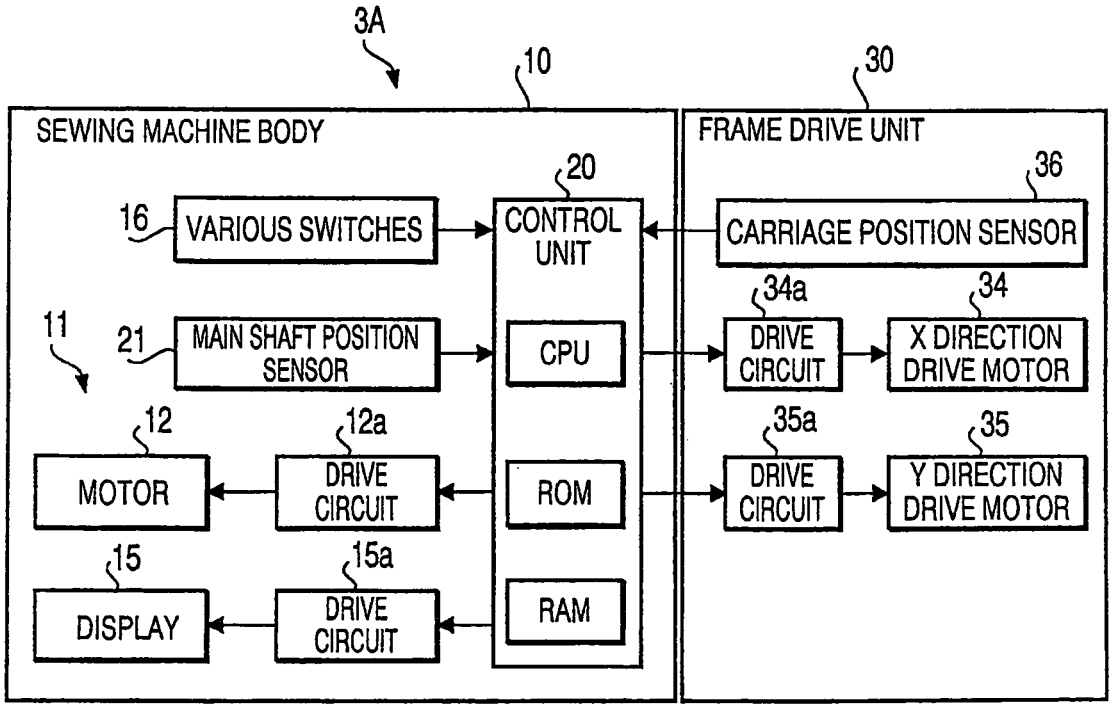
FIG. 35 is a block diagram of a control system of an embroidery sewing machine according to a third embodiment of the invention.

Hereinafter, the embroidery sewing machine 3A will be described. The embroidery sewing machine 3A is configured similarly to the embroidery sewing machine 3 in the first embodiment except the image sensor 14, i.e., the detecting system 37, the detection activating switch 17, the frame drive operation switches 18 i.e., the frame drive instruction system 38, and the position recording switch 19, which are not included in the embroidery sewing machine 3A (see FIGS. 4 through 5, and FIG. 35).

[Printing Device]

Figure 36:
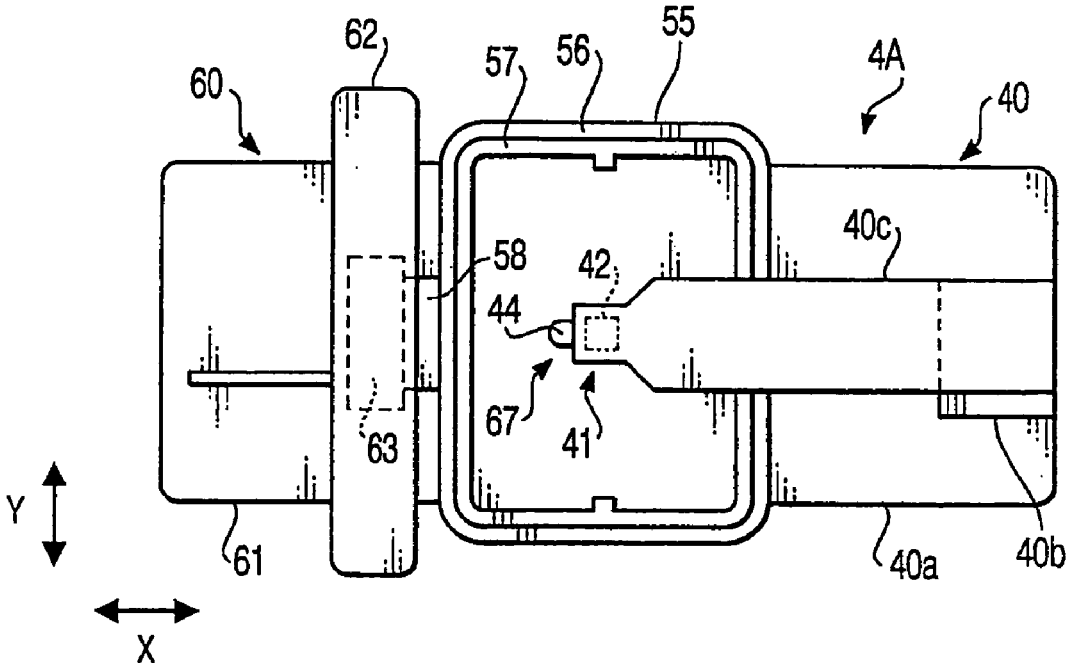
FIG. 36 is a plane view of a printing device according to the third embodiment of the invention.
Figure 37:
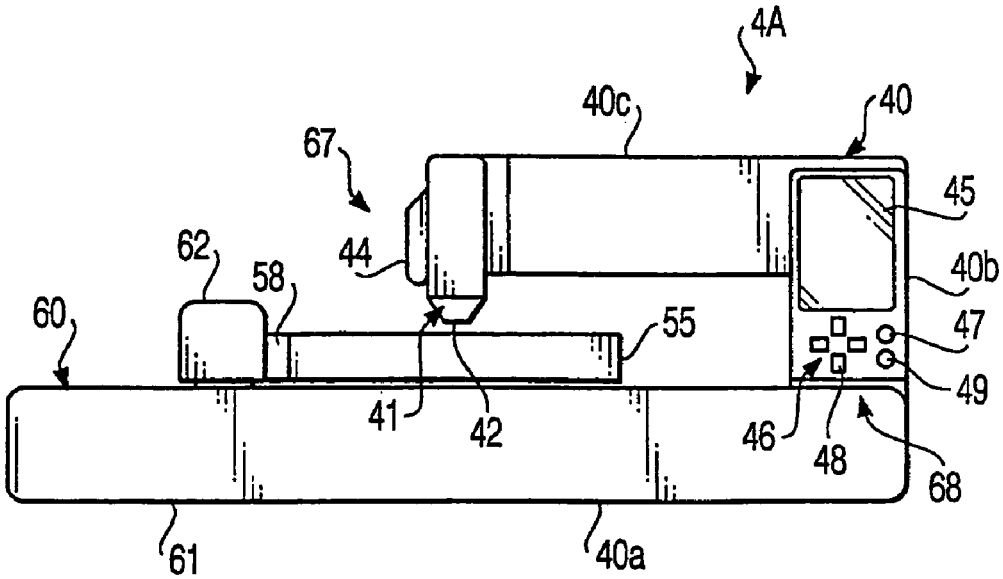
FIG. 37 is a front view of the printing device according to the third embodiment of the invention.
Figure 38:
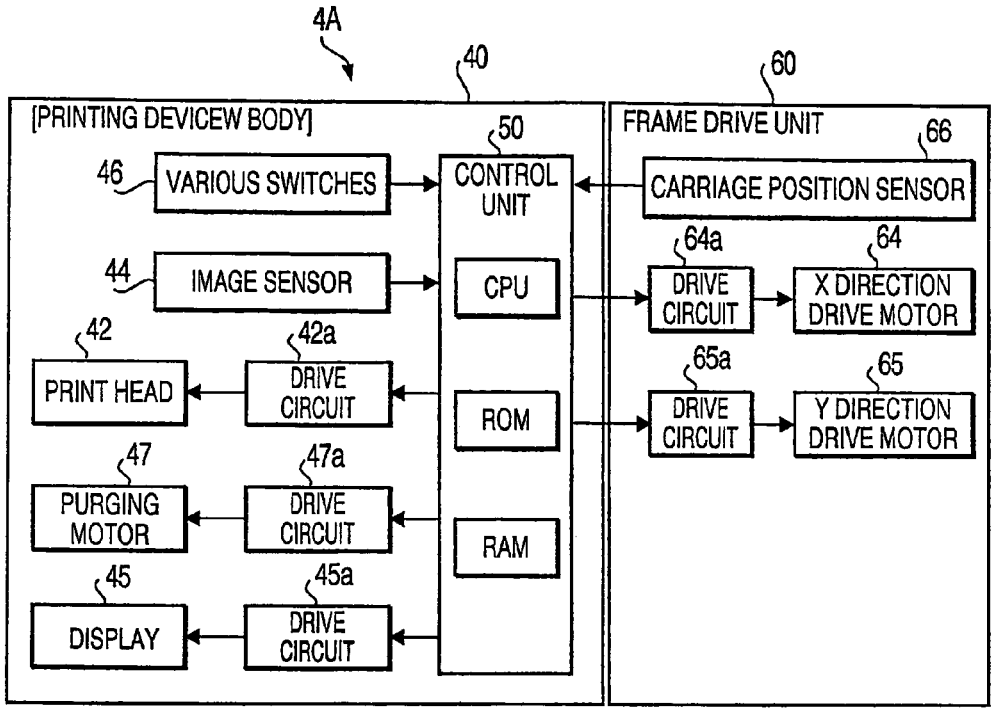
FIG. 38 is a block diagram of a control system of the printing device according to the third embodiment of the invention.

Hereinafter, the printing device 4A will be described. The printing device 4A is configured similarly to the printing device 4 in the first embodiment except an image sensor 44, i.e., a detecting system 67, a detection activating switch 47, a frame drive operation switches 48 i.e., a frame drive instruction system 68, and the position recording switch 49, which are added to the printing device 4A (see FIGS. 36 through 38).

A device body 40 is provided with an image sensor 44 at a free end of an arm 40*c* (in a vicinity to a print head 42), and a display 45 (a display system) and various switches 46 are provided on a front side of a pillar 40*b*. The image sensor 44 is adapted to read an image of a predetermined area of a fabric 5 that is held by a frame 55, which is attached to a frame drive unit 60. In the present embodiment, the image sensor 44 is configured to read an image from a relatively small area, however, the image sensor 44 may be configured to read an image from a greater area that may approximately coincide with an entire print area 55*a* inside the frame 55. A control unit 50 is connected to the image sensor 44.

It should be noted that, on the fabric 5, two cross-like reference marks 8, 9 (see FIG. 41) to indicate reference positions of the fabric 5 have been sewn by the embroidery sewing machine 3A. When the fabric 5 is transferred to the frame 55 of the printing device 4A, the fabric 5 is attached to the frame 55 so that the reference marks 8, 9 are located inside the frame 55 (i.e., the print area 55*a*). The printing device 4A is provided with the detecting system 67 that detects the reference marks 8, 9 indicating the two reference positions sewn on the fabric 5 by the embroidery sewing machine 3A. The detecting system 67 includes the image sensor 44, the control unit 50, and the frame drive unit 60, which have been described above.

The image sensor 44 is configured to read an image from a relatively small area on the fabric 5 that is held by the frame 55. With the above-described configuration, the control unit 50 controls the frame drive unit 60, which drives the frame 55, when an instruction to detect the reference marks is received. Then the image sensor 44 scans an image of the entire print area 55*a* on the fabric 5 inside the frame 55, and the image is analyzed so that the two reference marks 8, 9 are detected. Thus, positions of the two reference marks 8, 9 with respect to the frame 55 (i.e., the print area 55*a*), and a relative position (a current position) of the two reference marks 8, 9, and the print area 55*a* with respect to a printing device reference position 43*a* (a predetermined position 43*a* of the print head 42) can be detected (calculated by the control unit 50).

In the present embodiment, the various switches 46 including detection activating switch 47 (a detection activating system) that is operated to activate the detecting system 67, a frame drive operation switches 48 (a frame drive operation system) that include four arrow keys to drive the frame drive unit 60, and a position recording switch 49 are provided. The printing device 4A is provided with a frame drive instruction system 68 that instructs the frame drive unit 60 to drive the frame 55 so that each of the two reference marks 8, 9 coincides with the printing device reference position 43*a* sequentially based on information from the detecting system 67.

Figure 43:
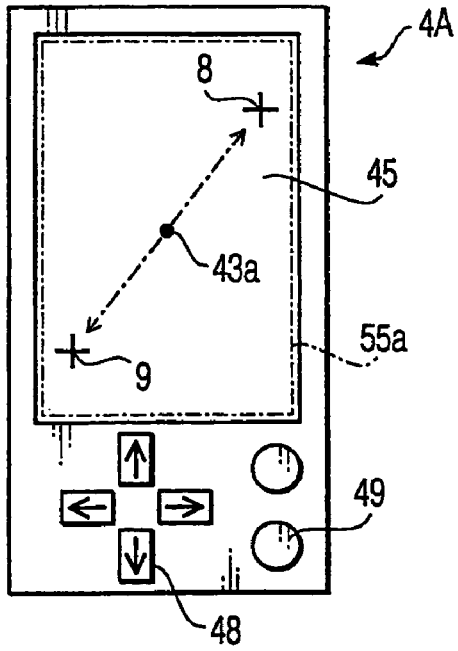
FIG. 43 is an illustrative view of a print area with the reference marks and an initial point for printing according to the third embodiment of the invention.

The frame drive instruction system 68 includes the frame drive operation switches 48 and the control unit 50. Based on the information from the detecting system 67, the frame drive instruction system 67 shows a positional relation of the printing device reference position 43*a*, the two reference marks 8, 9, and the print area 55*a* on the display 45, as shown in FIG. 43. Thus, a user can manipulate the frame 55 via the frame drive operation switches 48 by viewing the positional relation shown on the display 45, and the control unit 50 receiving signals from the frame drive operation switches 48 drives the frame 55 by controlling the X direction drive motor 64 or the Y direction drive motor 65, so that the two reference marks 8, 9 are sequentially coincided with the printing device reference position 43*a*.

After the two reference marks 8, 9 are sequentially coincided with the printing device reference position 43*a*, positional information (i.e., information of working position of the frame drive unit 60, which is information of position of a carriage 63 detected by a carriage position sensor 66) is recorded by operating the position recording switch 49. The control unit 50 is provided with a function (a print data modifying system) to modify the print data so that the initial printed pattern 7 represented by the print data, which is supplied by the data processing unit 2, can be formed on the fabric 5 in the predetermined alignment with respect to the fabric 5 and the embroidery pattern 6 based on the positional information that is obtained by having the reference marks 8, 9 sequentially coincided with the printing device reference position 43*a*.

[Data Processing Unit]

Figure 39:
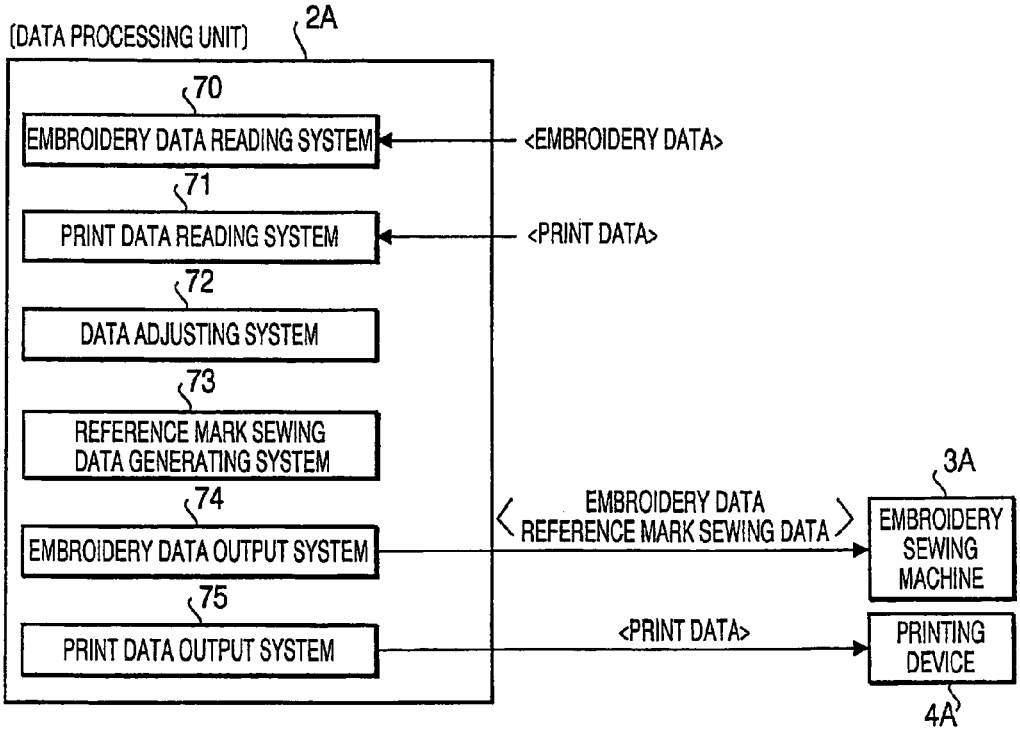
FIG. 39 is a block diagram to illustrate functions of a data processing apparatus according to the third embodiment of the invention.

Hereinafter, the data processing unit 2A will be described. As shown in FIG. 39, the data processing unit 2A is provided with a reference mark sewing data generating system 73*a*, which is adapted to generate reference mark sewing data for sewing the two cross-like reference marks 8, 9 indicating the two reference positions of the fabric 5 outside a print patterned area 7*a* (see FIG. 41) on the fabric 5, in which the printed pattern 7 is formed based on the print data read by a print data reading system 71, in place of the reference mark print data generating system 73 in the first embodiment.

The reference mark sewing data generating system 73*a* can be configured to generate reference mark sewing data for sewing the two reference marks 8, 9 outside the embroidery patterned area 6*a* on the fabric 5 that is to be formed the embroidery pattern 6 based on the embroidery data read by an embroidery data reading system 70. It should be noted that when the print data and the embroidery data are modified by a data adjusting system 72, the reference mark sewing data is generated based on the modified print data and the modified embroidery data.

With the above-described procedure, reference mark sewing data including reference mark positional data, which represents the positions of the two reference marks 8, 9, and reference mark color data, which represents the color of the patterned portion, are generated. Then, the reference mark positional data is added to the initial print data to be generated as current print data. Further, the embroidery data as well as the reference mark sewing data is supplied to the embroidery sewing machine 3A by an embroidery data output system 74, and the print data is supplied to the printing device 4A by a print data output system 75 online or via a recording medium such as CD and FD.

[Pattern Forming Method]

Figure 40:
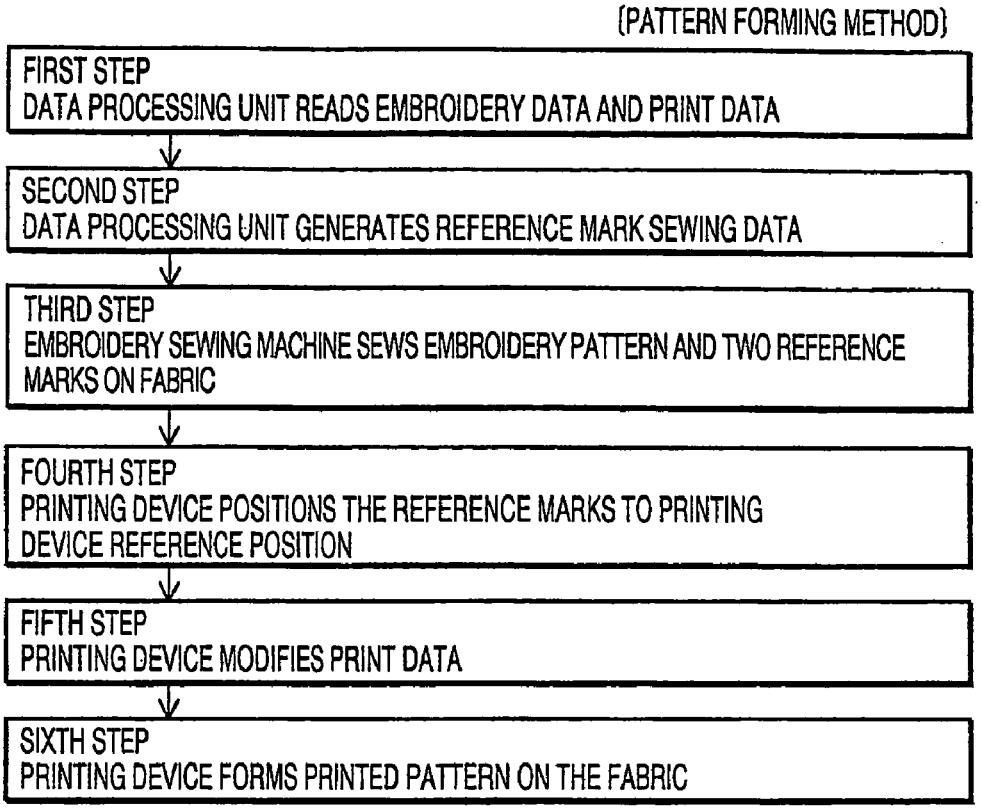
FIG. 40 is a process chart to illustrate a method for pattern forming according to the third embodiment of the invention.

Hereinafter, a pattern forming method will be described. As shown in FIG. 40, the pattern forming method includes steps 1 through 6. The first step is similar to the first step in the first embodiment. Next, in the second step, the data processing unit 2A generates the reference mark sewing data for sewing the reference marks 8, 9 that indicate the two reference positions of the fabric 5 based on the embroidery data and the print data read in the first step. Further, the data processing unit 2A supplies the embroidery data and the reference mark sewing data to the embroidery sewing machine 3A and the print data to the printing device 4A.

Next, in the third step, the embroidery sewing machine 3A forms the embroidery pattern 6 on the fabric 5 that is held by the frame 25 of the embroidery sewing machine 3A based on the embroidery data received from the data processing unit 2A. Further, after the embroidery pattern 6 is formed on the fabric 5, the embroidery sewing machine 3A sews the two reference marks 8, 9 based on the reference mark sewing data received from the data processing unit 2A (the two reference marks 8, 9 can be sewn prior to the embroidery pattern 6, however, in such case, the reference marks 8, 9 are formed outside the embroidery patterned area 6*a*) (see FIG. 41). It should be noted that the two reference marks 8, 9 are sewn on positions that are spaced from each other to a certain extent (in FIG. 41, the reference marks 8, 9 are located close to corners of the embroidery patterned area 6*a* opposing to each other), and the reference mark sewing data for forming the reference marks 8, 9 in such positions is generated in the second step.

Then, the fabric 5 is transferred from the frame 25 of the embroidery sewing machine 3A to the frame 55 of the printing device 4. In this regard, the fabric 5 is set in the frame 55 so that the reference marks 8, 9 are brought inside the frame 55 (in the print area 55*a*). Therefore, if the reference marks 8, 9 are located close to the corners opposing to each other, as described above, an approximate midpoint of the reference marks 8, 9 can be a target to be set in the center of the frame 55, and the print patterned area 7*a* can be positioned inside the frame 55. Thus, a situation that the printed pattern 7 cannot be formed on the fabric 5 can be avoided.

Figure 42:
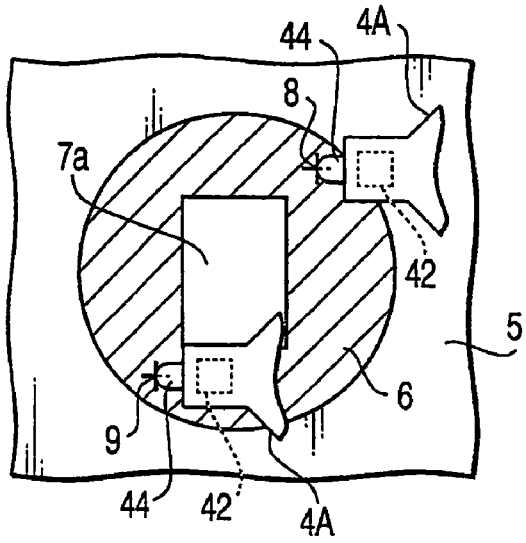
FIG. 42 is an illustrative view of the reference marks being detected according to the third embodiment of the invention.

With the frame 55 holding the fabric 5 attached to the frame drive unit 60 of the printing device 4A, the detecting system 67 of the printing device 4A is activated by an operation to the detection activating switch 47. Next, the frame 55 is automatically driven by the frame drive unit 60, and an entire image in the print area 55*a* on the fabric S inside the frame 55 is scanned by the image sensor 44 so that the two reference marks 8, 9 can be detected (see FIG. 42). Then the positional relation of the printing device reference position 43*a* and the two reference marks 8, 9 with the print area 55*a* is shown on the display 45 (see FIG. 43).

Next, in the fourth step, the frame drive unit 60 of the printing device 4A drives the frame 55 so that the two reference marks 8, 9 sewn on the fabric 5 in the third step are sequentially coincided with the printing device reference position 43*a*. In this regard, a user can manipulate the frame 55 through the frame drive operation switches 48 by viewing the positional relation shown on the display 45. After the two reference marks 8, 9 are sequentially coincided with the printing device reference position 43*a*, positional information (i.e., information of working position of the frame drive unit 60, which is information of position of the carriage 63 detected by the carriage position sensor 66) are recorded by operating the position recording switch 49.

Figure 44:
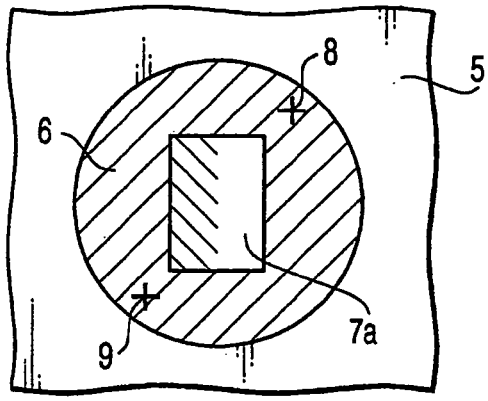
FIG. 44 is an illustrative view of a printed pattern being formed on the fabric according to the third embodiment of the invention.

Next, in the fifth step, based on the positional information that is obtained in the fourth step by having the reference marks 8, 9 sequentially coincided with the printing device reference position 43*a*, the printing device 4A modifies the initial print data so that the printed pattern 7 can be formed on the fabric 5 in the predetermined alignment with respect to the fabric 5 and the embroidery pattern 6. Next, in the sixth step, the printing device 4A forms the printed pattern 7 on the fabric 5 based on the current print data that has been modified in the fifth step (see FIG. 44). Further, if necessary, the reference marks 8, 9 are removed by being unstitched.

Figure 45:
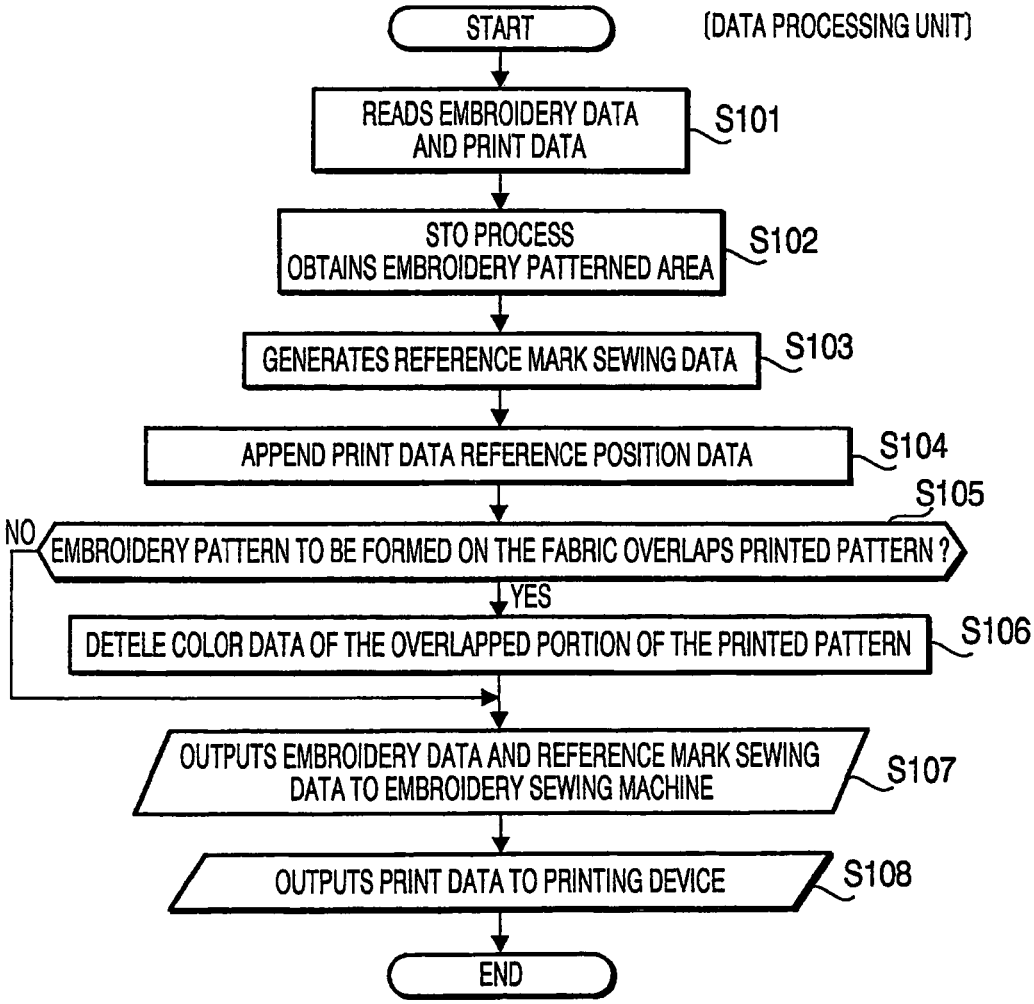
FIG. 45 is a flowchart illustrating a process to be executed by the data processing apparatus according to the third embodiment of the invention.

Hereinafter, a sequence of processes that are executed by the data processing unit 2A will be described (see FIG. 45). As shown in a flowchart in FIG. 45 (Si (i=101, 102, 103 . . . ) in the flowchart represents each step), S101 and S102 are similar to S1 and S2 in the first embodiment. Then, based on the embroidery data and the print data, further based on the embroidery patterned area 6*a* if necessary, the reference mark sewing data of the two reference marks 8, 9 is generated (S103). Further, the reference mark positional data is added to the initial print data (S104).

S105 and S106 are similar to S7 and S8 of the process of the data processing unit 2 in the first embodiment. If the embroidery pattern 6 is determined not to overlap the printed pattern 7 (S105: No), as well as after S106, the embroidery data and the reference mark sewing data are output to the embroidery sewing machine 3A (S107). Then, the print data is output to the printing device 4A (S108), and the process ends.

Figure 46:
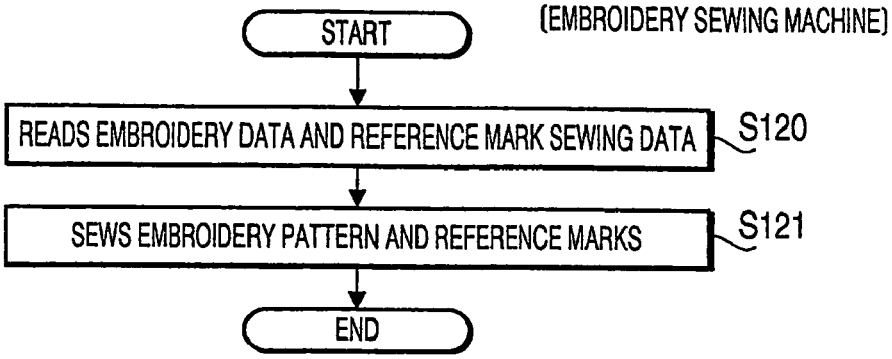
FIG. 46 is a flowchart illustrating a process to be executed by the embroidery sewing machine according to the third embodiment of the invention.

Hereinafter, a sequence of processes that are executed by the embroidery sewing machine 3A will be described. As shown in a flowchart in FIG. 46 (Si (i=120, 121) in the flowchart represents each step), when the process is started, the embroidery data and the reference mark sewing data that are supplied by the data processing unit 2A are read (S120). Then, the sewing system 11 and the frame drive unit 30 are controlled, and the embroidery pattern 6 and the two reference marks 8, 9 are sewn on the fabric 5 (S121), and the process ends.

Figure 47:
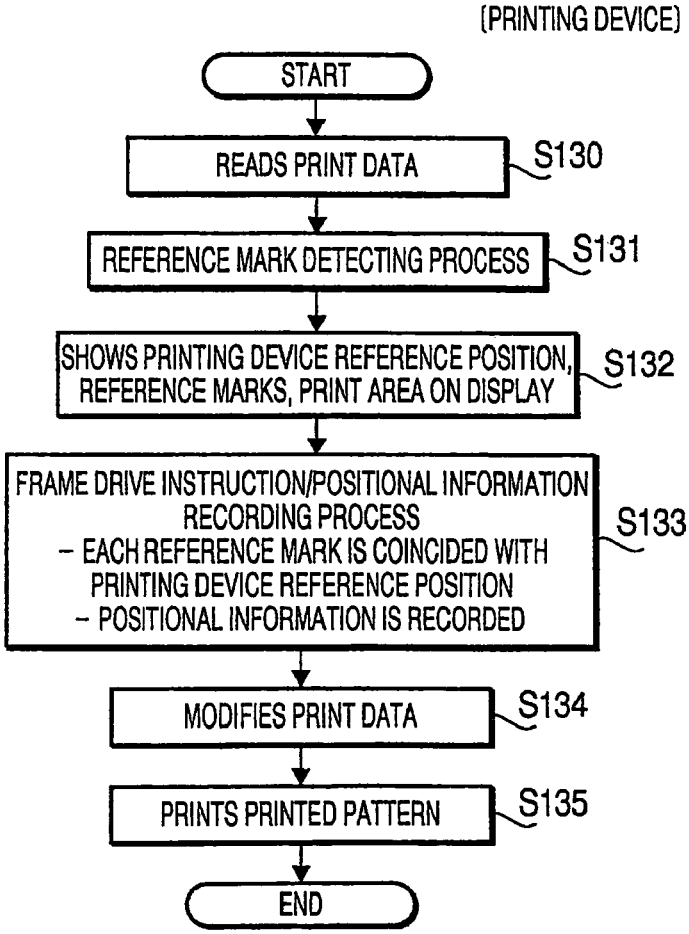
FIG. 47 is a flowchart illustrating a process to be executed by the printing device according to the third embodiment of the invention.

Hereinafter, a sequence of processes that are executed by the printing device 4A will be described. As shown in a flowchart in FIG. 47 (Si (i=130, 131, 132 . . . ) in the flowchart represents each step), when the process is started, the print data that are supplied by the data processing unit 2A is read (S130). Then, in a reference mark detecting process (S131), the image sensor 44 is activated by an operation to the detection activating switch 47, and the frame 55 is driven in a predetermined pattern so that the image on the fabric 5 is scanned and the two reference marks 8, 9 are detected. Then, the printing device reference position 43*a* and the reference marks 8, 9 with the print area 55*a* are shown on the display 45 (S132).

Next, in a frame drive instruction/positional information recording process (S133), the frame drive unit 60 drives the frame 55 by an operation to the frame drive operation switches 48 so that the two reference marks 8, 9 can be sequentially coincided with the printing device reference position 43*a*. After the two reference marks 8, 9 are coincided with the printing device reference position 43*a*, the positional information (i.e., the information of working position of the frame drive unit 60, which is information of position of the carriage 63 detected by the carriage position sensor 66) is recorded by operating the position recording switch 49. Next, based on the positional information, the initial print data is modified by having the reference marks 8, 9 sequentially coincided with the printing device reference position 43*a*, and the printed pattern 7 can be formed on the fabric 5 in the predetermined position with respect to the fabric 5 and the embroidery pattern 6 (S134). Then, based on the current print data that has been modified, the printing system 41 and the frame drive unit 60 are controlled, so that the printed pattern 7 is formed (S135). Then, the process ends.

This pattern forming system 1A is advantageous in the followings.

[Printing Device]

With the detecting system 67, the reference marks 8, 9 that indicate the two reference positions recorded on the fabric 5 that is held by the frame 55 can be detected. Further, with the frame drive instruction system 68, the frame drive unit 60 can have instructions to drive the frame 55 based on the detected information from the detecting system 67 so that the two reference marks 8, 9 can be sequentially coincided with the printing device reference position 43*a*. In other words, the two reference marks 8, 9 can be respectively coincided with the printing device reference position 43*a* in a simple and reliable manner, and based on the positional information obtained in such a manner, the printed pattern 7 can be formed on the fabric 5 in the predetermined position with respect to the reference marks 8, 9.

With the above-described configuration, the embroidery pattern 6 can be previously formed to be in the predetermined position with respect to the two reference marks 8, 9 on the fabric 5 before the printed pattern 7 is formed on the same fabric, and the reference marks 8, 9 as well can be formed on the fabric 5 prior to the printed pattern 7. Therefore, in such a case that the printed pattern 7 is formed on the fabric 5 after the embroidery pattern 6 is formed on the fabric 5 that is held by the frame 25 of the embroidery sewing machine 3A and the fabric 5 is transferred to the frame 55 of the printing device 4A, the printing device 4A is advantageous.

In other words, when the fabric 5 held by the frame 25 of the embroidery sewing machine 3A with the embroidery pattern 6 formed is transferred to the frame 55 of the printing device 4A, the fabric 5 does not require to be positioned specifically with respect to the frame 55 as long as the two reference marks 8, 9 and the print patterned area 7*a* in which the printed pattern 7 is to be formed are brought inside the frame 55 (i.e., the print area 55*a*) of the printing device 4A. Thus, the process to set the fabric 5 specifically in a predetermined position, which may be time consuming and troublesome, can be omitted. After the fabric 5 is transferred to the frame 55 of the printing device 4A, and the detecting system 67 and the drive instruction system 68 are operated, the printed pattern 7 can be formed on the fabric 5 so that the embroidery pattern 6 and the printed pattern 7 can be formed in the predetermined position with respect to each other, and thus, a quality of the composed patterns can be improved.

As the frame drive instruction system 68 includes the frame drive operation switches 48, which are used for operating the frame drive unit 60, the frame 55 is configured to be driven by the frame drive operation switches 48 via the frame drive unit 60 to have the two reference marks 8, 9 sequentially coincided with the printing device reference position 43*a*. Further, with the detection activation switch 47 that is operated to activate the detecting system 67, the detecting system 67 can be stopped while printing is performed by the printing device 4A. After the fabric 5 is transferred to the frame 55, the detecting system 67 can be activated when the printed pattern 7 is formed on the fabric 5 so that the two reference marks 8, 9 formed on the fabric 5 can be sequentially coincided with the printing device reference position 43*a* in the reliable manner.

With the display 45 that shows the printing device reference position 43*a* and the two reference marks 8, 9, the printing device reference position 43*a* and the two reference marks 8, 9 can be easily recognized, and the user can manipulate the frame 55 by viewing the positional relation of the two reference marks 8, 9 shown on the display 45 when the two reference marks 8, 9 are sequentially coincided with the printing device reference position 43*a* by operating the frame drive unit 60 via the frame drive operation switches 48. Further, as the display 45 shows the printing device reference position 43*a* and the two reference marks 8, 9 as well as the print area 55*a* inside the frame 55, the user can easily recognize the printing device reference position 43*a* and the two reference marks 8, 9 with the print area 55*a*.

Furthermore, with the print data modifying system that modifies the print data based on the positional information obtained by having the reference marks 8, 9 sequentially coincided with the printing device reference position 43*a*, the initial print data can be modified to be the current print data to be formed on the fabric 5, so that the printed pattern 7 can be formed on the fabric 5 specifically in the predetermined alignment with respect to the two reference marks 8, 9.

[Data Processing Unit]

With the reference mark sewing data generating system 73*a*, the reference mark sewing data, which is for sewing the two reference marks 8, 9 indicating the reference positions of the fabric 5, and for sewing the reference marks 8, 9 on the fabric 5 outside the print patterned area 7*a*, in which the printed pattern 7 is formed based on the print data read by the print data reading system 71, can be generated. Based on the reference mark sewing data, the two reference marks 8, 9 can be sewn on the fabric 5 by the embroidery sewing machine 3A.

When the embroidery pattern 6 and the printed pattern 7 are formed in the predetermined alignment with respect to each other on the fabric 5 with the embroidery pattern 6 formed on the fabric 5 by using the embroidery sewing machine 3A and the printed pattern 7 succeedingly formed on the fabric 5 by using the printing device 4A, as described above, the fabric 5 is required to be transferred from the frame 25 of the embroidery sewing machine 3A to the frame 55 of the printing device 4A. In this regard, the data processing unit 2A is advantageous in forming the embroidery pattern 6 and the printed pattern 7 on the fabric 5 in the predetermined alignment with respect to each other.

In other words, the two reference marks 8, 9 are formed on the fabric 5 by the embroidery sewing machine 3A as well as the embroidery pattern 6 is formed to be in the predetermined position with respect to the reference marks 8, 9. Next, after having the fabric 5 transferred from the frame 25 of the embroidery sewing machine 3A to the frame 55 of the printing device 4A, the printed pattern 7 can be formed to be in the predetermined alignment with respect to the two reference marks 8, 9 on the fabric 5. Accordingly, the embroidery pattern 6 and the printed pattern 7 can be formed on the fabric 5 in the predetermined alignment with respect to each other. In addition, as the reference marks 8, 9 that are sewn on the fabric 5 are outside the printed pattern 7, therefore, the printed pattern 7 can be normally formed on the fabric 5 and the sewn reference marks 8, 9 can be removed afterwards, so that an appearance and a quality of the composed patterns are improved.

When the reference mark sewing data generating system 73*a* is adapted to generate reference mark sewing data for sewing the reference marks outside the embroidery patterned area 6*a* on the fabric 5 in which the embroidery pattern 6 is to be formed based on the embroidery data read by the embroidery data reading system 70, the reference marks 8, 9 can be formed on the fabric 5 so that the reference marks 8, 9 can be reliably recognized.

[Pattern Forming Method]

In the first step and the second step, which are similar to the first and second steps in the first embodiment, the embroidery pattern 6 and the printed pattern 7 can be formed on the fabric 5 in the predetermined alignment with respect to each other.

Following the second step, the embroidery sewing machine 3A is adapted to form the embroidery pattern 6 on the fabric 5 that is held by the frame 25 of the embroidery sewing machine 3A based on the embroidery data, and before or after the embroidery pattern 6 is formed on the fabric 5, the embroidery sewing machine 3A is further adapted to sew the two reference marks 8, 9 based on the reference mark sewing data. Accordingly, the embroidery pattern 6 can be formed on the fabric 5 in the predetermined position with respect to the reference marks 8, 9, and the two reference marks 8, 9 as well as the embroidery pattern 6 can be formed on the fabric 5.

With the fabric 5 transferred from the frame 25 of the embroidery sewing machine 3A to the frame 25 of the printing device 4A, the printing device 4A is adapted to manipulate the frame 55 via the frame drive unit 60. Further, in the fourth step, the printing device 4A is adapted to have the two reference marks 8, 9 sewn on the fabric 5 in the third step to be sequentially coincided with the printing device reference position 43*a*. In the fifth step, based on the positional information that is obtained in the fourth step by having the reference marks 8, 9 sequentially coincided with the printing device reference position 43*a*, the printing device 4A is adapted to modify the initial print data so that the printed pattern 7 can be formed on the fabric 5 in the predetermined alignment with respect to the reference marks 8, 9. In the sixth step, the printing device 4A is adapted to form the printed pattern 7 on the fabric 5 based on the current print data that has been modified in the fifth step.

Accordingly, when the fabric 5 with the embroidery pattern 6 formed by the embroidery sewing machine 3A is transferred from the frame 25 of the embroidery sewing machine 3A to the frame 55 of the printing device 4A, the fabric 5 does not require to be positioned specifically with respect to the frame 55 as long as the two reference marks 8, 9 and the print patterned area 7*a* in which the printed pattern 7 is to be formed are brought inside the frame 55 (i.e., the print area 55*a*) of the printing device 4A. Thus, the process to set the fabric 5 in a predetermined position, which may be time consuming and troublesome, can be omitted, and the embroidery pattern 6 and the printed pattern 7 can be readily and reliably formed on the fabric 5 in the predetermined alignment with respect to each other.

The third embodiment can be altered as follows.

[Printing Device] 1] The frame drive instruction system 68 may include the control unit 50 (an automatic positioning control system) that controls the frame drive unit 60 to have the two reference marks 8, 9 to be automatically coincided with the printing device reference position 43*a*. In such case, the frame drive operation switches 48 can be omitted, and the printing device reference position 43*a* and the reference marks 8, 9 are not required to be shown on the display 45. In this regard, the two reference marks 8, 9 formed on the fabric 5 that is held by the frame 55 can be detected by the detecting system 67, and the positions of the two reference marks 8, 9 (current positions) with respect to the printing device reference position 43*a* can be detected. Therefore, the printing device 4A can be configured to calculate a distance in the X direction and a distance in the Y direction from the current positions to the printing device reference position 43*a*, so that the frame 55 can be driven for the calculated distances in the two directions to have the reference marks 8, 9 to be sequentially coincided with the printing device reference position 43*a*. In such case, the positional information of the reference marks 8, 9 sequentially coincided with the printing device reference position 43*a* can also be automatically recorded. In this regard, the position recording switch 49 can be omitted.

2] The printing device reference position 43*a*, which is located in the vicinity to the print head 42, can be located in another position. The printing device reference position is preferable to be located in a vicinity of the free end of the arm 40*c* (in a vicinity to the print head 42) of the device body 40. In such a location, a positioning system for positioning the two reference marks 8, 9 on the fabric 5 held by the frame 55 can be provided in a vicinity of the free end of the arm 40*c* (in a vicinity to the print head 42) so that the two reference marks 8, 9 can be respectively coincided with the printing device reference position. Examples of such a configuration will be described below.

Figure 48:
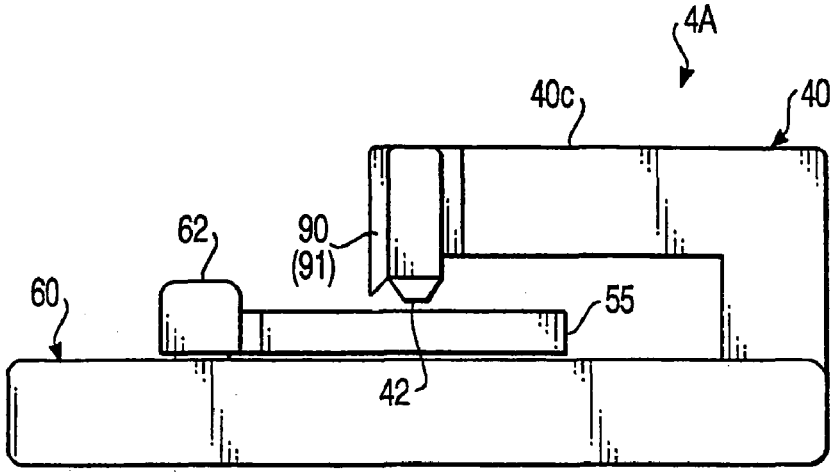
FIG. 48 is a front view of a variation of the printing device according to the third embodiment of the invention.
Figure 49:
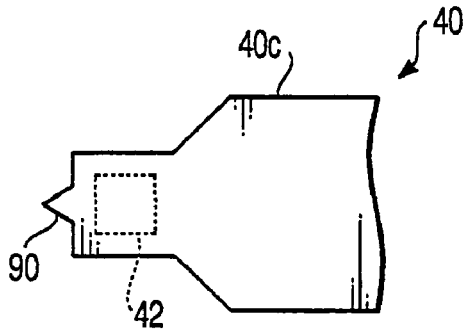
FIG. 49 is a plane view of an essential part of the printing device shown in FIG. 48 according to the third embodiment of the invention.
Figure 50:
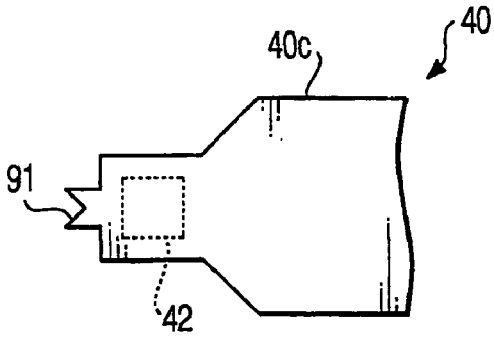
FIG. 50 is a plane view of an essential part of the printing device shown in FIG. 48 according to the third embodiment of the invention.

2-1] As shown in FIGS. 48 and 49, the positioning system including a positioning member 90 with a protrusion is provided at a predetermined portion in a vicinity to the print head 42 of the arm 40*c* of the device body 40. With the positioning member 90, the user can have the reference marks 8, 9 on the fabric 5 coincided with the protrusion of the positioning member 90 to be positioned reliably by viewing the positioning member 90 from the above. 2-2] As shown in FIGS. 48 and 50, the positioning system including a positioning member 91 with a cutout is provided at a predetermined portion of the arm 10*c* of the machine body 10 in a vicinity to the print head 42. With this positioning member 91, the user can have the reference marks 8, 9 on the fabric 5 coincided with the cutout of the positioning member 91 by viewing the positioning member 91 from the above.

Figure 51:
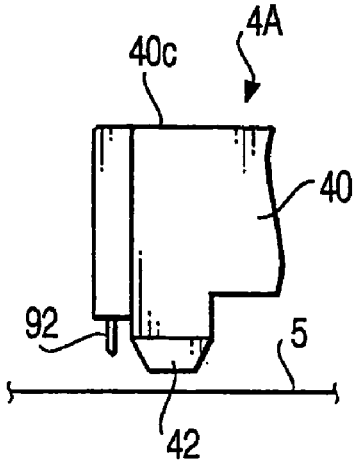
FIG. 51 is a front view of a variation of the printing device according to the third embodiment of the invention.
Figure 52:
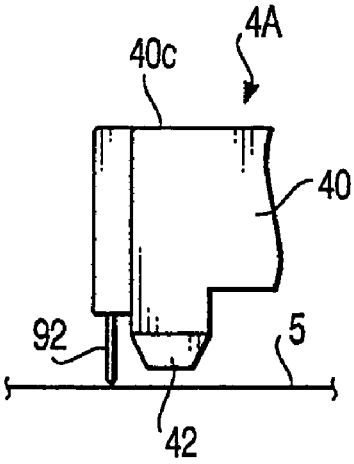
FIG. 52 is a front view of a variation of the printing device according to the third embodiment of the invention.

2-3] As shown in FIGS. 51 and 52, the positioning system including a movable positioning member 92 that can be positioned close to or far from the fabric 5 held by the frame 25 is provided at a predetermined portion of the arm 40*c* of the device body 40 in a vicinity to the print head 42. In this case, the movable positioning member 92 can be configured to move manually or automatically. The movable positioning member 92 is adapted to be brought close to the fabric 5, so that the movable positioning member 92 can indicate the reference marks 8, 9 on the fabric 5, therefore, the position of the fabric 5 can be reliably recorded. When printing is performed and the movable positioning member 92 is not used, the movable positioning member 92 can be separated from the fabric 5 so that the movable positioning member 92 does not interfere the printing operation.

Figure 53:
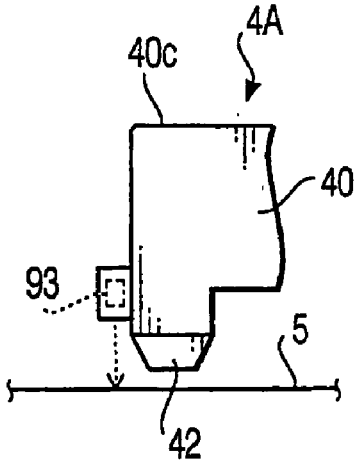
FIG. 53 is a front view of a variation of the printing device according to the third embodiment of the invention.

2-4] As shown in FIG. 53, the positioning system including a spotlight 93 as a emitting system that emits spotlight to the fabric 5 held by the frame 55 is provided at a predetermined portion of the arm 40*c* of the device body 40 in a vicinity to the print head 42. The emitted spotlight is adapted to indicate the reference marks 8, 9 on the fabric 5, so that the position of the fabric 5 can be reliably recorded. In addition, the emitting system can be provided to a portion where the emitting system does not interfere the printing operation.

3] The number of the reference marks is not limited to two, but may be more than two. 4] When each of the embroidery pattern 6 and the printed pattern 7 is a symmetrical pattern with respect to a point, the number of the reference mark can be one. In this case, the one reference mark can be formed as the symmetrical point of the pattern to be formed on the fabric. 5] The print head 42 of the device body 40 can be configured to be driven in the Y direction (or the X direction), while the frame drive unit 60 is configured to be driven only in the X direction (or the Y direction), so that the point to be printed by the print head 42 with respect to the fabric 5 can be moved in the two directions independently.

[Data Processing Unit] 6] The reference mark sewing data generating system 73*a* can be adapted to generate reference mark sewing data for sewing reference marks indicating the reference positions of the fabric 5 in various shapes (for example dots, circles, line segments) other than the crosses.

Figure 41:
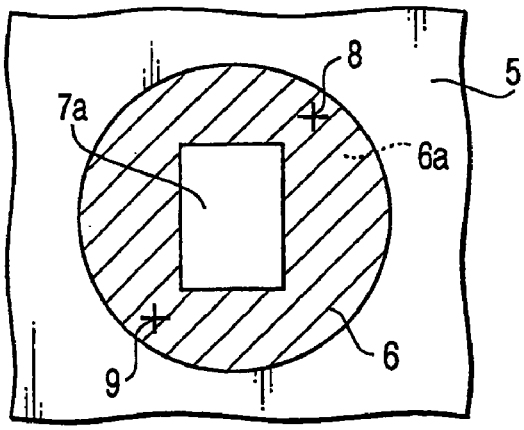
FIG. 41 is an illustrative view of an embroidery pattern and reference marks formed on a fabric according to the third embodiment of the invention.

[Pattern Forming Method] In FIG. 41, the printed pattern 7 is to be provided inside the embroidery patterned area 6*a*, however, the embroidery patterned area 6*a* can be provided inside the print patterned area 7*a*. In this regard, the reference marks 8, 9 are formed outside the printed pattern 7*a*.

According to the present invention, a printing and embroidery system including a mark input system, which is adapted to input position of a predetermined mark formed on a fabric that is held by a second fabric holding member, a data modifying system, which is adapted to modify a second image data based on the position of the mark inputted, is provided. With this system, the position of the mark formed on the fabric can be inputted, and the second image data can be modified based on the position of the mark so that the second image data can be printed or embroidered.

According to the present invention, the mark position input system includes a mark detecting system, which is adapted to detect the predetermined mark formed on the fabric, and a mark position input system, which is adapted to input the position of the detected mark. With this configuration, the position of the mark formed on the fabric can be detected, and the second image data can be modified according to the position of the detected mark to be printed or to be embroidered.

According to the present invention, the mark input system includes a fabric holding member drive system, which is adapted to drive the second fabric holding member, a pointing system, which is adapted to have the position of the detected mark coincided with a predetermined reference position of a second unit, and an operation system, which is adapted to be operated when the position of the detected mark is coincided with the predetermined reference position of the second unit. With this configuration, the position of the detected mark can be reliably inputted by driving the second fabric holding member and by having the position of the detected mark coincided with the predetermined position.

According to the present invention, a printing and embroiodery system including a mark position recording system and a position adjusting system is provided. The mark position recording system, which is detachably attached to the first fabric holding member and the second fabric holding member, is adapted to record the position of the predetermined mark formed on the fabric according to the positional data by being attached to the first fabric holding member. The position adjusting system is adapted to elicit a misalignment between the position of the predetermined mark on the fabric that is held by the second fabric holding member and the position of the predetermined mark on the fabric when the fabric was held by the first fabric holding member by having the mark position recording system attached to the position adjusting system. With this configuration, the printing and embroidery system can elicit the misalignment between the position of the predetermined mark on the fabric when the fabric is held by the second fabric holding member and the position of the predetermined mark on the fabric when the fabric is held by the first fabric holding member, so that the fabric is held by the second fabric holding member in a predetermined alignment without having a specific detecting system.

According to the present invention, the position adjusting system is adapted to change the position of the fabric held by the second fabric holding member without changing a position of the mark position recording system. With this configuration, the position of the fabric can be adjusted while the mark position recording system is in position in the second fabric holding member.

According to the present invention, a printing unit including a fabric holding member drive system that is adapted to drive a fabric holding member, a pointing system that is adapted to have a position of a detected mark coincided with a predetermined position of the printing unit, and an operation system that is adapted to be operated when the position of the detected mark is coincided with a predetermined position of a second unit so that the position of the detected mark is inputted is provided. With this configuration, the position of the detected mark can be reliably inputted by having the fabric holding member driven.

According to the present invention, a printing unit including a mark position recording system and a position adjusting system. The mark position recording system is adapted to be detachably attached to the fabric holding member so that a position of a predetermined mark formed on a fabric is recorded according to positional data. The position adjusting system is adapted to elicit a misalignment between a position of a predetermined mark on a fabric that is held by a fabric holding member and a position of the predetermined mark formed on the fabric by having the mark position recording system attached to the fabric holding member with the fabric being attached. With this configuration, the misalignment between the position of the predetermined mark on the fabric when the fabric is held by the fabric holding member and the position of the predetermined mark previously formed on the fabric can be elicited, so that the fabric is held by the fabric holding member in a predetermine alignment with respect to the fabric holding member.

According to the present invention, a printing unit including the position adjusting system that is adapted to change the position of the fabric without changing the position of the mark position recording system attached to the fabric holding member. With this configuration, the position of the fabric can be adjusted while the position of the mark position recording system attached to the fabric holding member is maintained.

According to the present invention, an embroidery unit including a fabric holding member drive system that is adapted to drive a fabric holding member, a pointing system that is adapted to have a position of a detected mark coincided with a predetermined position of the embroidery unit, and an operation system that is adapted to input the position of the detected mark by being operated when the position of the detected mark is coincided with a predetermined position of a second unit. With this configuration, the position of the detected mark can be reliably inputted by having the fabric holding member driven.

According to the present invention, an embroidery unit including a mark position recording system and a position adjusting system is provided. The mark position recording system is adapted to record a position of a predetermined mark formed on a fabric according to positional data. The position adjusting system is adapted to elicit a misalignment between a position of the predetermined mark on the fabric held by a fabric holding member and a position of the predetermined mark formed on the fabric by having the mark position recording system attached to the fabric holding member with the fabric being held. With this configuration, the misalignment between the position of the predetermined mark on the fabric when the fabric is held by the fabric holding member and the position of the predetermined mark previously formed on the fabric can be elicited, so that the fabric is held by the fabric holding member in a predetermine alignment with respect to the fabric holding member.

According to the present invention, an embroidery unit including the position adjusting system that is adapted to change the position of the fabric without changing the position of the mark position recording system attached to the fabric holding member. With this configuration, the position of the fabric can be adjusted while the position of the mark position recording system attached to the fabric holding member is maintained.

According to the present invention, a method for printing and embroidering is provided. The method include providing one of printing and embroidering based on a second image after a mark formed on a fabric in a predetermined position with respect to a first fabric holding member is coincided with a predetermined position with respect to a second fabric holding member. With this configuration, second image data can be printed or embroidered in a correct positional relation with respect to the second fabric holding member after having the fabric transferred from a first fabric holding member to the second fabric holding member.

According to the present invention, a method for printing and embroidering is provided. The method includes modifying second image data so that a misalignment between a position of a mark formed in a predetermined position with respect to a first fabric holding member and a predetermined position with respect to a second fabric holding member is corrected, and providing one of printing and embroidering on the fabric according to the modified second image. With this configuration, a first image data and the second image data can be printed and embroidered in a correct alignment with respect to each other after the fabric is transferred from the first fabric holding member to the second fabric holding member.

According to the present invention, a printing and embroidery system including a second image forming unit is provided. The second image forming unit is adapted to provide one of printing and embroidering on a fabric based on a second image after a mark formed in a predetermined position on the fabric with respect to a first fabric holding member is coincided with a predetermined position with respect to a second fabric holding member. With this configuration, the second image data can be printed or embroidered in a correct alignment with respect to the second fabric holding member after the fabric is transferred from the first fabric holding member to the second fabric holding member.

According to the present invention, a printing and embroidering system including a second image forming unit is provided. The second image forming unit is adapted to modify a second image data so that a misalignment between a mark formed in a predetermined position on a fabric with respect to a first fabric holding member and a predetermined position with respect to a second fabric holding member is corrected, and providing one of printing and embroidering on the fabric according to the modified second image. With this configuration, a first image data and the second image data can be printed and embroidered in a correct alignment with respect to each other after the fabric is transferred from the first fabric holding member to the second fabric holding member.

What is claimed is:

1. An embroidering unit with a fabric holding member to form an embroidery pattern on a fabric held by the fabric holding member based on image data, comprising:

an automatic mark detecting system comprising an image sensor that independently detects at least two predetermined marks printed in ink on the fabric held by the fabric holding member, a fabric holding member drive system, which is adapted to drive the fabric holding member in two directions independently, a mark position input system, which is adapted to input positions of the at least two detected predetermined marks, a modifying system, which is adapted to modify the image data, so that a position of the embroidery pattern represented by positional data appended to the image data can correspond to the positions of the at least two predetermined marks, according to the positional data appended to the image data and the positions of the at least two predetermined marks, and an automatic positioning control system adapted to control the fabric holding member drive system so that the at least two predetermined marks are automatically coincided with a predetermined reference position.

2. The embroidering unit according to claim 1, wherein the mark position input system includes a mark position record input system, which is adapted to input the positions of the at least two detected predetermined marks with respect to the embroidering unit, and a pointing system, which is adapted to judge whether the predetermined reference position being fixed with respect to the embroidering unit coincides with the positions of the detected at least two predetermined marks, and wherein the positions of the detected at least two predetermined marks with respect to the fabric holding member are inputted by having the fabric holding member of the sewing unit driven by the fabric holding member drive system and having the detected at least two predetermined marks coincided with the predetermined reference position.

3. An embroidery sewing machine comprising:

a sewing system with a needle, a fabric holding frame, which is adapted to detachably hold a fabric, a frame drive system, which is adapted to drive the fabric holding frame in two directions independently, an automatic detecting system comprising an image sensor that independently detects at least two reference marks indicating at least two reference positions printed in ink on the fabric held by the fabric holding frame, and a frame drive instruction system, which is adapted to instruct the frame drive system to drive the fabric holding frame so that the at least two reference marks sequentially coincide with a predetermined sewing machine reference position by operating the frame drive system based on detected information from the automatic detecting system, the frame drive instruction system including an automatic positioning control system, which is adapted to control the frame drive system to have the at least two reference marks automatically coincide with the at least two sewing machine reference positions.

4. The embroidery sewing machine according to claim 3, comprising a display system, which is adapted to display the sewing machine reference position and the at least two reference marks.

5. The embroidery sewing machine according to claim 4, wherein the display system displays the sewing machine reference position and the at least two reference marks with an embroidery area, which is provided inside the fabric holding frame.

6. The embroidery sewing machine according to claim 3, comprising an embroidery data modifying system, which is adapted to modify the embroidery data based on positional information obtained by having the at least two reference marks respectively coincided with the sewing machine reference position so that the embroidery pattern can be formed on the fabric in a predetermined position with respect to the at least two reference marks.

7. The embroidering unit according to claim 1, wherein the predetermined mark is printed in a color determined according to a color of the embroidery pattern to be formed.

8. The embroidery sewing machine according to claim 3, comprising a detection activating system that is operated to activate the automatic detecting system.

9. The embroidery sewing machine according to claim 3, wherein the sewing machine reference position is a stitch point of the needle.

10. The embroidery sewing machine according to claim 3, wherein the frame drive instruction system includes a frame drive operation system, which is adapted to operate the frame drive system.

11. The embroidery sewing machine according to claim 10, comprising a detection activating system that is operated to activate the automatic detecting system.

12. The embroidery sewing machine according to claim 3, wherein the at least two reference marks are recorded in a color determined according to a color of an embroidery pattern to be formed.

* * * * *